US012173436B2

(12) United States Patent
Bailie

(10) Patent No.: US 12,173,436 B2
(45) Date of Patent: Dec. 24, 2024

(54) METHODS AND SYSTEMS FOR PRODUCING PATCHES THAT HAVE SIMULATED OVERLOCK STITCHING

(71) Applicant: Brian D. Bailie, Albuquerque, NM (US)

(72) Inventor: Brian D. Bailie, Albuquerque, NM (US)

( * ) Notice: Subject to any disclaimer, the term of this patent is extended or adjusted under 35 U.S.C. 154(b) by 0 days.

(21) Appl. No.: 17/900,201

(22) Filed: Aug. 31, 2022

(65) Prior Publication Data

US 2023/0072904 A1 Mar. 9, 2023

Related U.S. Application Data

(60) Provisional application No. 63/240,848, filed on Sep. 3, 2021.

(51) Int. Cl.
*D05B 19/12* (2006.01)
*D05B 19/10* (2006.01)

(52) U.S. Cl.
CPC ..... *D05B 19/12* (2013.01); *D05B 19/10* (2013.01)

(58) Field of Classification Search
CPC ..... D05B 19/12; D05B 19/10; D05B 25/00; D05B 57/08
See application file for complete search history.

(56) References Cited

U.S. PATENT DOCUMENTS 1,301,758 A * 4/1919 Stern ..... A41D 1/14 112/400
4,585,684 A * 4/1986 Mackarous ..... B44C 3/085 156/213
5,149,388 A * 9/1992 Stahl ..... D06M 17/10 428/187
5,569,345 A * 10/1996 Kenyon ..... A41D 27/08 428/102
2005/0103248 A1* 5/2005 Kwon ..... D05C 17/00 112/475.18
2006/0021113 A1* 2/2006 Wenkman ..... A41D 27/08 2/244

(Continued)

FOREIGN PATENT DOCUMENTS

JP 2000288281 A * 10/2000
JP 3231530 U * 4/2021

*Primary Examiner* — Tajash D Patel
(74) *Attorney, Agent, or Firm* — LOZA & LOZA, LLP; Richard H. Krukar

(57) ABSTRACT

Embroidery machines can produce patches without needing overlock machines. An outline definition for the outline of the patch is obtained and used to determine the exterior points of an exterior path. The interior points of an interior path that is inside the exterior path can also be determined. The exterior path and the interior path can be used to produce sewing data that includes an edge stitch pattern definition for an edge stitch pattern that includes a plurality of edge stitches that are arranged as a plurality of stitch bundles. The stitch bundles are fan shaped and extend from the exterior path to the interior path, the exterior points and the interior points indicate a plurality of needle penetrations for sewing the edge stitch pattern, and the sewing data is configured for use by an embroidery machine to sew the edge stitch pattern and thereby produce simulated overlock stitching.

20 Claims, 13 Drawing Sheets

(56) References Cited

U.S. PATENT DOCUMENTS

| | | | | |
|---|---|---|---|---|
| 2006/0143789 | A1* | 7/2006 | Kronenberger | A42B 1/248 2/184 |
| 2016/0095369 | A1* | 4/2016 | Roberts | A41D 19/01535 2/160 |

* cited by examiner

METHODS AND SYSTEMS FOR PRODUCING PATCHES THAT HAVE SIMULATED OVERLOCK STITCHING

CROSS REFERENCE TO RELATED APPLICATIONS

This patent application claims the priority and benefit of U.S. provisional patent application No. 63/240,848, titled "SYSTEMS AND METHODS FOR AN EMBROIDERED REPRESENTATION OF AN OVERLOCK STITCH," filed on Sep. 3, 2021, which is herein incorporated by reference in its entirety.

TECHNICAL FIELD

The embodiments relate to overlock stitching machines, embroidery machines, overlock stitches, embroidery stitches, sewing data usable by embroidery machines for producing embroidery patterns, cloth patches with embroidered designs and edge stitching produced by an overlock machine, and to producing simulated overlock stitches on patches.

BACKGROUND

In the art of making patches, also known as emblems, there are two machines required: An embroidery machine and an overlock machine. The embroidery machine uses sewing data that includes a decorative stitch pattern definition to sew a decorative pattern onto the interior area of a patch. The overlock machine adds finish stitching to the edge of the patch so that it is durable and washable. The decorative stitch pattern definition contains no data that is interpreted by the overlock machine. In fact, sewing the finish stitching using the overlock machine has been a manual process. There are numerous patches that are pre-cut for sale in the industry, and they often have their outlines available for the purpose of designing the interior of the patch.

BRIEF SUMMARY OF SOME EXAMPLES

The following presents a summary of one or more aspects of the present disclosure, in order to provide a basic understanding of such aspects. This summary is not an extensive overview of all contemplated features of the disclosure and is intended neither to identify key or critical elements of all aspects of the disclosure nor to delineate the scope of any or all aspects of the disclosure. Its sole purpose is to present some concepts of one or more aspects of the disclosure as a prelude to the more detailed description that is presented later.

One aspect of the subject matter described in this disclosure can be implemented by a method. The method can include obtaining an outline definition of an outline, using the outline definition to determine a plurality of exterior points of an exterior path, determining a plurality of interior points of an interior path that is inside the exterior path, and using the exterior path and the interior path to produce sewing data that includes an edge stitch pattern definition for an edge stitch pattern that includes a plurality of edge stitches that are arranged as a plurality of stitch bundles, wherein the stitch bundles are fan shaped and extend from the exterior path to the interior path, the exterior points and the interior points indicate a plurality of needle penetrations for sewing the edge stitch pattern, the sewing data is configured for use by an embroidery machine to sew the edge stitch pattern and thereby produce simulated overlock stitching.

Another aspect of the subject matter described in this disclosure can be implemented as a non-transitory computer readable medium storing computer readable instructions, that when executed on one or more processors implements a method. The method can include obtaining an outline definition of an outline, using the outline definition to determine a plurality of exterior points of an exterior path, determining a plurality of interior points of an interior path that is inside the exterior path, and using the exterior path and the interior path to produce sewing data that includes an edge stitch pattern definition for an edge stitch pattern that includes a plurality of edge stitches that are arranged as a plurality of stitch bundles, wherein the stitch bundles are fan shaped and extend from the exterior path to the interior path, the exterior points and the interior points indicate a plurality of needle penetrations for sewing the edge stitch pattern, the sewing data is configured for use by an embroidery machine to sew the edge stitch pattern and thereby produce simulated overlock stitching.

Yet another aspect of the subject matter described in this disclosure can be implemented in a system. The system can include an exterior path definition means for defining an exterior path, an interior path definition means for defining an interior path that is inside the exterior path, an edge stitch definition means for defining an edge stitch pattern that includes a plurality of edge stitches that are arranged as a plurality of stitch bundles, and a sewing data means that includes the edge stitch definition means, wherein the exterior path definition means and the interior path definition means are used to produce the edge stitch definition means, the stitch bundles are fan shaped and extend from the exterior path to the interior path, the sewing data means is configured for use by a sewing means to sew the edge stitch pattern and thereby produce simulated overlock stitching.

In some implementations of the methods and devices the stitch bundles include a first one of the stitch bundles, a second one of the stitch bundles, and a third one of the stitch bundles, the second one of the stitch bundles is sewn after the first one of the stitch bundles is sewn, the third one of the stitch bundles is sewn after the second one of the stitch bundles is sewn, the edge stitch pattern definition specifies a plurality of running stitches, the second one of the stitch bundles includes an extended point, the third one of the stitch bundles includes a second extended point, one of the running stitches extends from the extended point to the second extended point, and the one of the running stitches is sewn after the first one of the stitch bundles is sewn and before the third one of the stitch bundles is sewn. In some implementations of the methods and devices the edge stitch pattern definition specifies a plurality of middle run stitches between the running stitches and the exterior path, the middle run stitches are parallel to the running stitches and the exterior path, one of the middle run stitches is sewn before the third one of the stitch bundles is sewn and after the first one of the stitch bundles is sewn.

In some implementations of the methods and devices, the method can include storing the sewing data on a non-transitory storage medium. In some implementations of the methods and devices, the method can include producing the simulated overlock stitching by sewing the edge stitch pattern. In some implementations of the methods and devices, the method can include obtaining a plurality of sewing parameters, wherein the sewing parameters include an edge stitch width, and the edge stitch width is used to determine an offset between the exterior path and the interior path.

In some implementations of the methods and devices, the method can include calculating a plurality of edge angles at a plurality of the exterior points, using the edge angles to determine that one of the exterior points is a segment endpoint, identifying a first end segment and a second end segment that overlap at the segment endpoint, producing a plurality of lapped corner stitch definitions for a plurality of lapped corner stitches, and including the lapped corner stitch definitions in the edge stitch pattern definition, wherein sewing the lapped corner stitches produces a lapped corner where the first end segment and the second end segment overlap. In some implementations of the methods and devices, an overlapping corner stitch is a one of the lapped corner stitches of the first end segment that is inside the second end segment, and the edge stitch pattern definition is adjusted to exclude a plurality of overlapping corner stitches from the edge stitch pattern. In some implementations of the methods and devices, the method can include comparing the edge angles to a threshold outside edge angle, wherein the one of the exterior points is the segment endpoint because a one of the edge angles at the one of the exterior points is less than the threshold outside edge angle.

In some implementations of the methods and devices, the method can include calculating a plurality of edge angles at a plurality of the interior points, using the edge angles to determine that one of the interior points is a segment endpoint, identifying a first end segment and a second end segment that overlap at the segment endpoint, producing a plurality of lapped corner stitch definitions for a plurality of lapped corner stitches, and including the lapped corner stitch definitions in the edge stitch pattern definition, wherein sewing the lapped corner stitches produces a lapped corner where the first end segment and the second end segment overlap.

In some implementations of the methods and devices, the method can include producing a plurality of cover stitch definitions for a plurality of cover stitches that have a plurality of outside edge stitch points spaced at an initial spacing value along the exterior path, that have a plurality of inside edge stitch points along the interior path, and that overlay an edge area that is between the outside edge and the interior path, grouping the cover stitch definitions into a plurality of stitch bundle definitions for the stitch bundles, increasing an intra-bundle spacing of the outside edge stitch points to a final spacing value, and decreasing the intra-bundle spacing of the inside edge stitch points. In some implementations of the methods and devices, the stitch bundle definitions include a plurality extended stitch definitions for a plurality of extended stitches, wherein an extended stitch is a one of the cover stitches that has an inside edge stitch point extending past the interior path by a predetermined extension distance. In some implementations of the methods and devices, none of the stitch bundle definitions include more than one of the extended stitch definitions. In some implementations of the methods and devices, the method can include calculating a plurality of edge angles at a plurality of the outside edge stitch points, using the edge angles to determine that one of the outside edge stitch points is a segment endpoint, identifying a first end segment and a second end segment that overlap at the segment endpoint, producing a plurality of lapped corner stitch definitions for a plurality of lapped corner stitches, and including the lapped corner stitch definitions in the edge stitch pattern definition, wherein sewing the lapped corner stitches produces a lapped corner where the first end segment and the second end segment overlap.

In some implementations of the methods and devices, the system can include a means for identifying a first end segment and a second end segment, and a means for defining a plurality of lapped corner stitches that are included in the edge stitch pattern, wherein sewing the lapped corner stitches produces a lapped corner where the first end segment and the second end segment overlap. In some implementations of the methods and devices, the sewing data includes a running stitch definition means for defining a plurality of running stitches, the sewing data includes a middle run stitch definition means for defining a plurality of middle run stitches, and sewing the simulated overlock stitching produces the running stitches and the middle run stitches.

These and other aspects will become more fully understood upon a review of the detailed description, which follows. Other aspects, features, and embodiments will become apparent to those of ordinary skill in the art, upon reviewing the following description of specific, exemplary embodiments in conjunction with the accompanying figures. While features may be discussed relative to certain embodiments and figures below, all embodiments can include one or more of the advantageous features discussed herein. In other words, while one or more embodiments may be discussed as having certain advantageous features, one or more of such features may also be used in accordance with the various embodiments discussed herein. In similar fashion, while exemplary embodiments may be discussed below as device, system, or method embodiments such exemplary embodiments can be implemented in various devices, systems, and methods.

BRIEF DESCRIPTION OF THE DRAWINGS

Aspects of the embodiments described herein will be better understood from the following detailed description with reference to the drawings. The drawings are not to scale.

Throughout the description, similar reference numbers may be used to identify similar elements.

DETAILED DESCRIPTION

Figure 1:
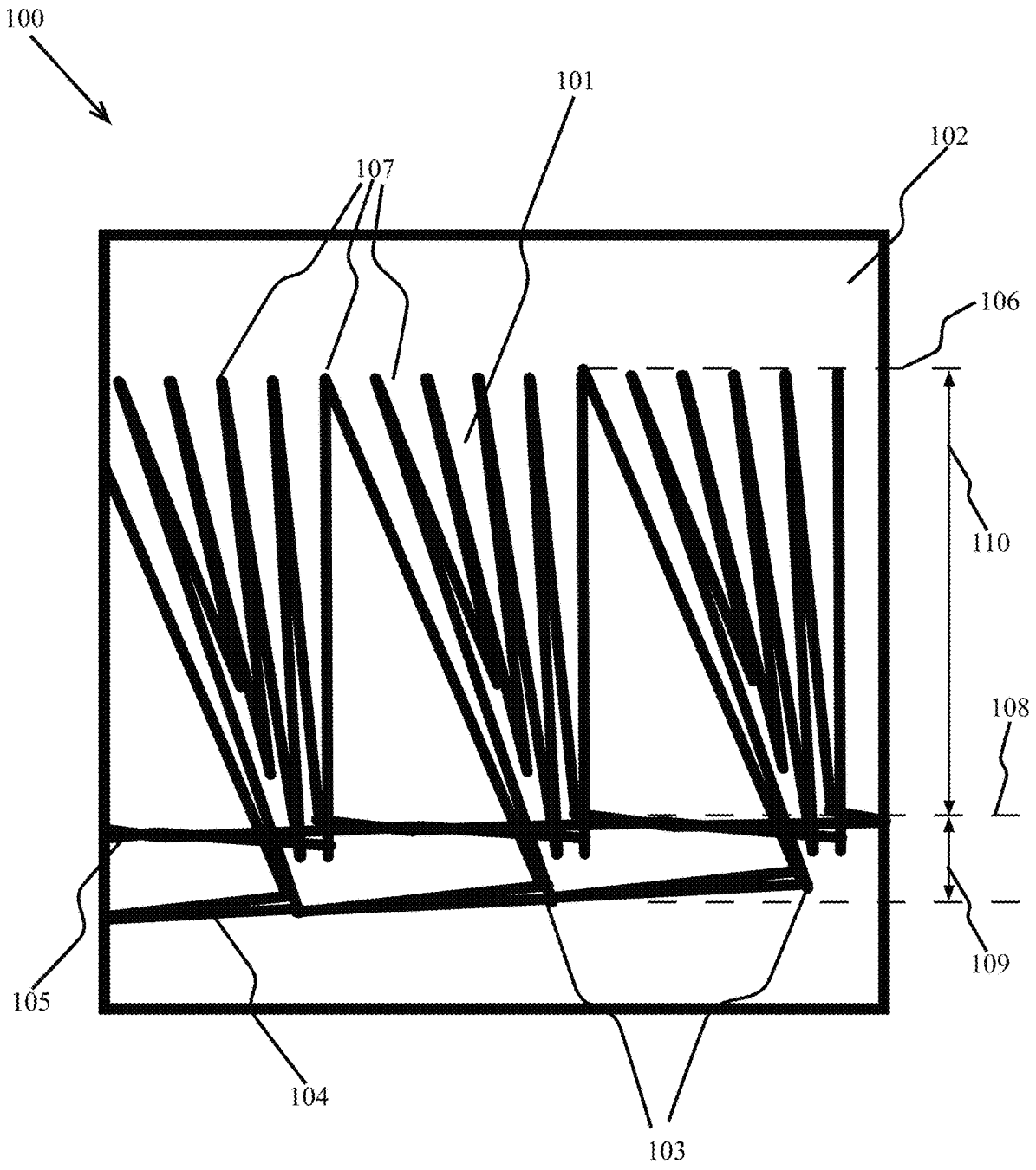
FIG. 1 is an image of an edge stitch pattern that is a simulated overlock stitch that has been sewn on a substrate according to some aspects.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

Overlock machines are often used to produce the edge stitching on patches. The overlock machine represents a significant cost that can be eliminated once the embroidery machine is given a design that creates edge stitching. The embroidery machine produces edge stitching that serves the same purpose and approximates the look of the overlock machine stitches. Skilled artists have manually produced designs for producing edge stitching for specific patterns. New patterns require specific attention by a skilled and rare artisan. An executable computer program has been produced that implements a method for automatically generating patch edge stitching, allowing an inexperienced user to create what previously took great skill.

FIG. 1 is an image of an edge stitch pattern 100 that is a simulated overlock stitch that has been sewn on a substrate 102 according to some aspects. The edge stitch pattern 100 includes stitch bundles 101, middle run stitches 105, and running stitches 104. The outside edge stitch points 107 at the wide parts of the fan shaped stitch bundles 101 are along an outside edge 106 of the edge stitch pattern. The middle run stitches 105 run along the inside interior path 108 of the edge stitch pattern 100. Each of the stitch bundles 101 has an extended point 103 that extends past the interior path 108 by a predetermined extension distance 109. The running stitches 104 appear to connect the extended points 103. The stitch pattern shown in FIG. 1 has stitches that have been expanded to more clearly show stitches.

The method for producing the simulated overlock stitching of FIG. 1 includes importing a shape or an outline that describes the edge of a patch. The outline can be imported from a graphics file such as a .svg file, a .png file, a .jpg file, etc. The file may explicitly contain an outline definition of the shape in a vector format. The file may contain a rasterized image of the outline in which case an edge detector may identify the outline of the shape and produce an outline definition. Those practiced in computer programming, and computer graphics in particular, are familiar with vector graphics file formats, raster graphics file formats, edge detectors, etc. Alternatively, the user can draw the outline using a program that may output the outline definition in a format such as that of an .svg file. The outline definition can represent the outside edge of the patch.

To use the method described here, a user can select the outline by, for example, clicking a button in a graphical user interface. In response to the user selecting the outline, the executable code can cause the software to create an edge stitch pattern definition and include the edge stitch pattern definition in the sewing data containing the embroidery design of a patch. The user may then take the sewing data from the computer to the embroidery machine. The embroidery machine may then use the sewing data to sew the patch, including the edge stitches. The embroidered cloth is then released from the machine and the edges are cut away outside the stitching.

Most overlock machines can not turn right while producing finish stitches or overlock stitches and can only turn left at a radius greater than the minimum radius that is a physical constraint of the overlock machine. As such, overlock machines can follow a clockwise path around an outline, but only if the outline has no turns below the machine's minimum turn radius. In order to make a sharp turn (e.g., at the corner of a rectangle), the operator of an overlock machine sews two segments by sewing the first segment and stitching off the edge of the patch, lifting the presser foot of the machine, turning the patch into position for the next edge, placing it under the presser foot, lowering the presser foot, and then sewing the second segment. Overlock machines allow for sewing off of fabric by creating a chain of stitching that comes off the needle plate and foot. When the turns are made, the chains are tucked under the patch to be trimmed later.

Edges stitches can be created using an outline path. The outline can be represented by an ordered series of points. The points can indicate where to simulate the travel of an overlock machine as it would finish the edge of a piece of cloth.

Path descriptions are common and well known to all computing arts. For example, it is well known to describe a path using a series of points such that line segments drawn from each point to the next produces the outside edge. It is also well known to define a path using points on a Bezier curve. Those practiced in the computing arts know of numerous other ways to describe a path. The path can be the outside edge of the patch, which is also the outside edge of the overlock stitching.

A stitch can be described by two points, much as two points can describe a line segment, where a needle penetration at one of the points and then the next can produce the stitch. A stitch pattern can be described by an ordered series of points, much as a series of points can describe a series of joined line segments. An embroidery machine can produce the stitch pattern via an ordered series of needle penetrations at the points in the ordered series of points. A stitch pattern has a width (we can call it the edge stitch width or pattern width) that extends inward from the exterior path, creating an interior path. The interior path is constructed to represent the possible travel of an overlock machine by breaking the outline into outline segments. Outline segments are segments of the outline that, in combination, form the outline. The outline segments can be determined from the outline and the ability of an overlock machine to follow the outline. The locations where the foot of the overlock machine must be lifted in order to follow the outline may define the start and stop locations of the outline segments.

The outline data can be augmented by outline metadata for use in determining where to position the segment ends. The points along the path can have preceding points and successive points. Each point can have point metadata that includes parameters such as a first distance, a second distance, and a divergence angle. The first distance can be a distance between the point and a selected preceding point. The selected preceding point can be the preceding point having the distance closest to the pattern width. A first line segment can be defined for the point as the line segment joining the point and the selected preceding point. Similarly for the second distance. The second distance can be a distance between the point and a selected successive point. The selected successive point can be the successive point having the distance closest to the pattern width. A second line segment can be defined for the point as the line segment joining the point and the selected successive point. The divergence angle can be defined as the inside angle at the point that is formed by the first line segment and the second line segment.

The metadata can be evaluated to identify turns in the outline where the outline segments end. A point can denote a segment end if the divergence angle at the point is less than a threshold angle. The threshold angle can be set to maintain a stitching density such as at least one stitch every 0.4 millimeters.

For example, where angles that may represent a turn are observed, the turn is evaluated. The method can scan all points and their metadata looking for the highest incidence of right turn. If the angle is greater than 45 degrees, clockwise, which is a 'right turn' for this purpose, the path must be broken into two paths, each containing the inflection point. The method can iteratively evaluate all separated paths, until no more path breaks occur. Each path now represents a segment of the overlock process.

The interior edges can now be computed. Each half edge, created by the points on the paths, are offset. This is similar to any normal inflation process used in the arts of computing or digital graphics, however, there are differences that are singular to this discovery and embroidery in general.

An interior path can be created by offsetting from the outline by a set distance such as the pattern width. This value is often 3/16 of an inch due to historical precedent dating over a century. The interior path can be defined as an ordered series of interior path points. The number of interior path points is often equal to the number of exterior path points.

Normally, but not here, offsetting a path causes no conflict for tools such as cutting dies. Here, however, conflicts arise because thread in an embroidery machine has no ability to lift or discontinue its presence along the line. This gives rise to conflicts. Some conflicts are caused by the existence of loops where the path intersects itself, a common condition. More conflicts arise due to the fact that the width of the resultant set of stitches includes a series of pairs of stitches placed at angles relative to the path. This type of stitching is known in the art as a satin stitch, based on the smooth appearance that is the result of the stitch. Because of these unique limitations, offsetting a path in an embroidery design is a more complex operation than normal graphics or robotics.

The stitch pattern can be a satin stitch pattern that includes many stitches. The stitches can be perpendicular to the outside edge. The stitch pattern can follow the segments to thereby produce stitching that appears to be overlock stitches produced by an overlock machine.

As discussed above the outside edge can be divided into outside edge segments. The inside edge includes inside edge segments that match each outside edge segment. The inside edge segment points at which the inside edge segments intersect can be called divergence points. In the embroidery arts the location where the segments join in this fashion is called a lapped corner.

A divergence point can be defined on the inside edge where the inside edge segments join. The stitch pattern proceeds in various directions as it is sewn. The stitch pattern has a direction as it approaches a divergence point and can be continued in the same direction past the divergence point to the outside edge.

Each stitch passing from the outside path to the inside path can be described using a pair of points. These pairs of points, each pair representing a point on the original path, and a point on the offset path, represent not only the shape of the segment, but the angles at which the stitches will be formed. The stitching can be performed using an iterative process of generating satin stitches, and variants of this are commonplace in the industry. The simplest form of which is to define a density of stitching along the inside edge or the outside edge, then create steps along that shape at intervals approximating the density. As such, the inside edge and the outside edge may have the same number of points. This is a very simple example, used for information only, as the process is far more complex, but common in the art.

Figure 6:
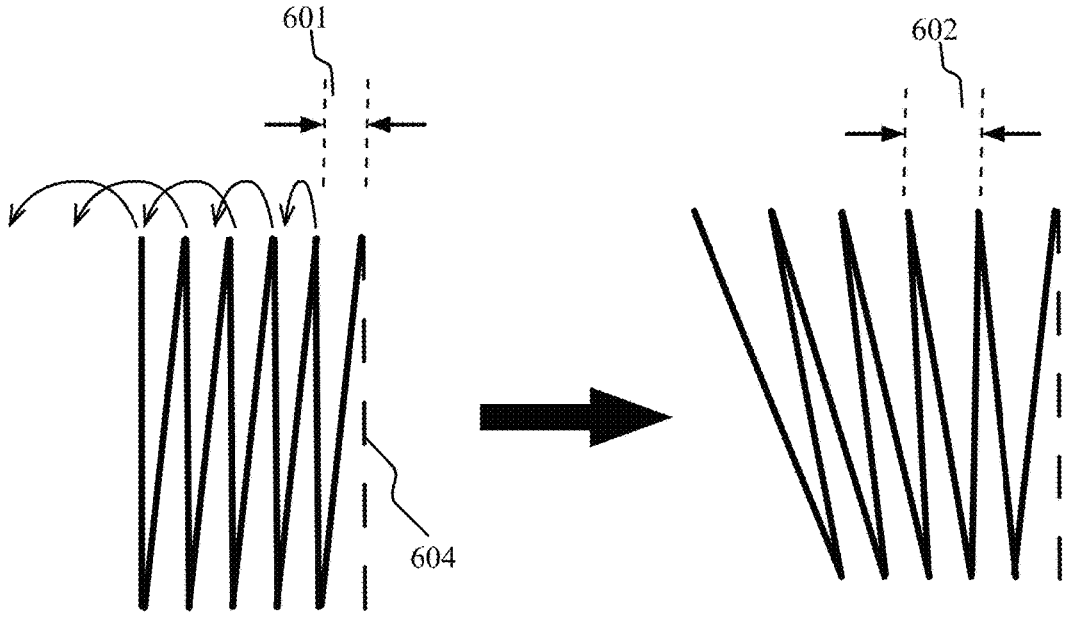
FIG. 6 is a diagram illustrating increasing the intra-bundle spacing of outside edge stitch points according to some aspects.

The stitch pattern at this point in the process may appear as shown in FIG. 6 which shows a satin stitch pattern between the outside edge and the inside edge. A process of shaping the stitch pattern to produce the appearance of overlock stitch may now be applied.

Stitching in the overlock machine will overlap, and look to an observer as if consecutive stitches overlie one another such that the stitch pattern covers the outside edge of the patch. To the observer, the stitches appear to fan out. To mimic this, the original density of the satin stitch is made to be higher than required. The interior edge is then stepped in increments equivalent to the stitch length of the overlock machine, commonly 1.7 mm. Groups of stitches within each step represent a bundle of stitches that will be transformed into the appearance of a single overlock stitch. The first step of this is to increase the space between the stitches such that the earliest stitches will overlap the prior bundle of stitches. This way, each bundle has the appropriate density of stitch for embroidery, commonly the value of 0.4 mm is used for this purpose.

Satin stitches are commonly used to completely cover underlying fabric with thread. The stitch density can be selected based on the thread thickness to provide coverage without wasting thread. For example, a satin stitch may be specified as having a stitch density of 0.4 mm. A higher stitch density may be needed to mimic overlock stitches. The number of stitches can be increased by a stitch density multiplier such as 1.3, which is a 30% increase in stitch density. The stitch density multiplier may be a sewing parameter that a user can input or adjust. Alternatively, the stitch density may be selected directly. For example, a stitch density of 0.3 mm may be selected directly. The stitch pattern can include inside points along the inside edge and outside points along the outside edge. A satin stitch pattern alternates between inside points and outside points.

A bundling process can group sets of consecutive stitches into bundles and reposition the inside points and the outside points. For example, every 1.7 mm section of stitches can be grouped into a bundle. The bundling process can move the outside points of a bundle by repositioning them along the outside edge at a bundle outside spacing (e.g., 0.5 mm). Moving the outside points apart causes each bundle to overlap its neighbor.

The bundling process can move the inside points of a bundle close together such that the needle penetrations on the inside edge are grouped closely together but remain distinct. For example, a bundle inside spacing (e.g., 0.1 mm) can be defined. The inside points of a bundle can be grouped along the inside edge by repositioning them along the inside edge at the bundle inside spacing.

After the bundling process, each stitch bundle is now fanned out, overlaps its neighboring bundles along the outside edge, and its inside points are gathered into nearly a single point in the middle of the bundle along the inside edge. This creates the fan shaped and over-edge appearance of the overlock stitch.

Another characteristic of an overlock stitch is created by the needle on the top of the fabric. The needle creates a series of straight stitches, known as a running stitch. The needle thread is also wrapped by the machine's mechanical looper with the threads that travel over the edge. They go over the edge, connect to a lower thread, come back above the fabric, go around the needle, which anchors the stitch in place. This process leaves a loop of thread around the run stitch. The look of this is distinctive in that it has a curve in it. Normal stitching is always straight, but the process of being formed around the round needle, and held in place at that point, causes this unusual stitch formation by the overlock machine.

An embroidery machine can emulate the unusual stitch formation of the running stitches. To simulate the effect of the running stitches extended points for each bundle are created and simulated running stitches are added that join the extended points to one another. An extended point is an inside point that is repositioned past the inside edge by a bundle inside offset. For example, the inside offset can approximate the width of the overlock needle (e.g., 0.7 mm) to thereby help mimic the running stitches of overlock machines.

Next, simulated running stitches can be added that connect the extended point of each bundle to the extended point of the next bundle. The simulated running stitches should be sewn early because the final stitching, that which represents the overlock machine's needle run, will push against it, causing it to curve in place. As such, the edge stitch pattern definition can be configured such that, for each bundle, the first stitch sewn goes from the outside edge to the extended point and the second stitch sewn is a simulated running stitch that goes from the extended point to the next bundle's extended point.

Middle run stitches can be added that appear to be a line of stitches along the inside edge to thereby emulate the overlock machine's needle stitch. The needle stitch can be simulated by adding middle run stitches after the final interior stitch of the bundle. The middle run stitches go toward the center of the bundle, where the run would normally overlap the bundle, as seen by observing an overlock stitch, the stitch then goes past that to a point where the overlock needle would have landed before the loop was formed, then another stitch is placed after that where the needle would land after the loop was formed. This process effectively creates the buildup of thread on the fabric that would happen between stitches on the overlock.

At the end of each segment, the final bundles of stitching are evaluated as to whether they are contained within the next segment or not. If they are not, the topstitching detail (the simulated running stitches and the middle run stitches) is not performed, thus reducing the amount of thread buildup in these interior corners.

As discussed above, an embroidery machine can use sewing data that includes a decorative stitch pattern definition to sew a decorative pattern onto the interior area of a patch. The sewing data can also include an edge stitch pattern definition. As such, the embroidery machine can sew the decorative pattern and can also sew a representation of the overlock stitching that would otherwise be produced by an overlock machine. The edge stitch pattern definition can include definitions for each of the stitches represented by each bundle that are ordered to form an unbroken chain of stitches. The edge stitch pattern definition can by interpreted be an embroidery machine can interpret to thereby sew an edge stitch pattern that mimics an overlock stitch produced by an overlock machine.

Figure 2:
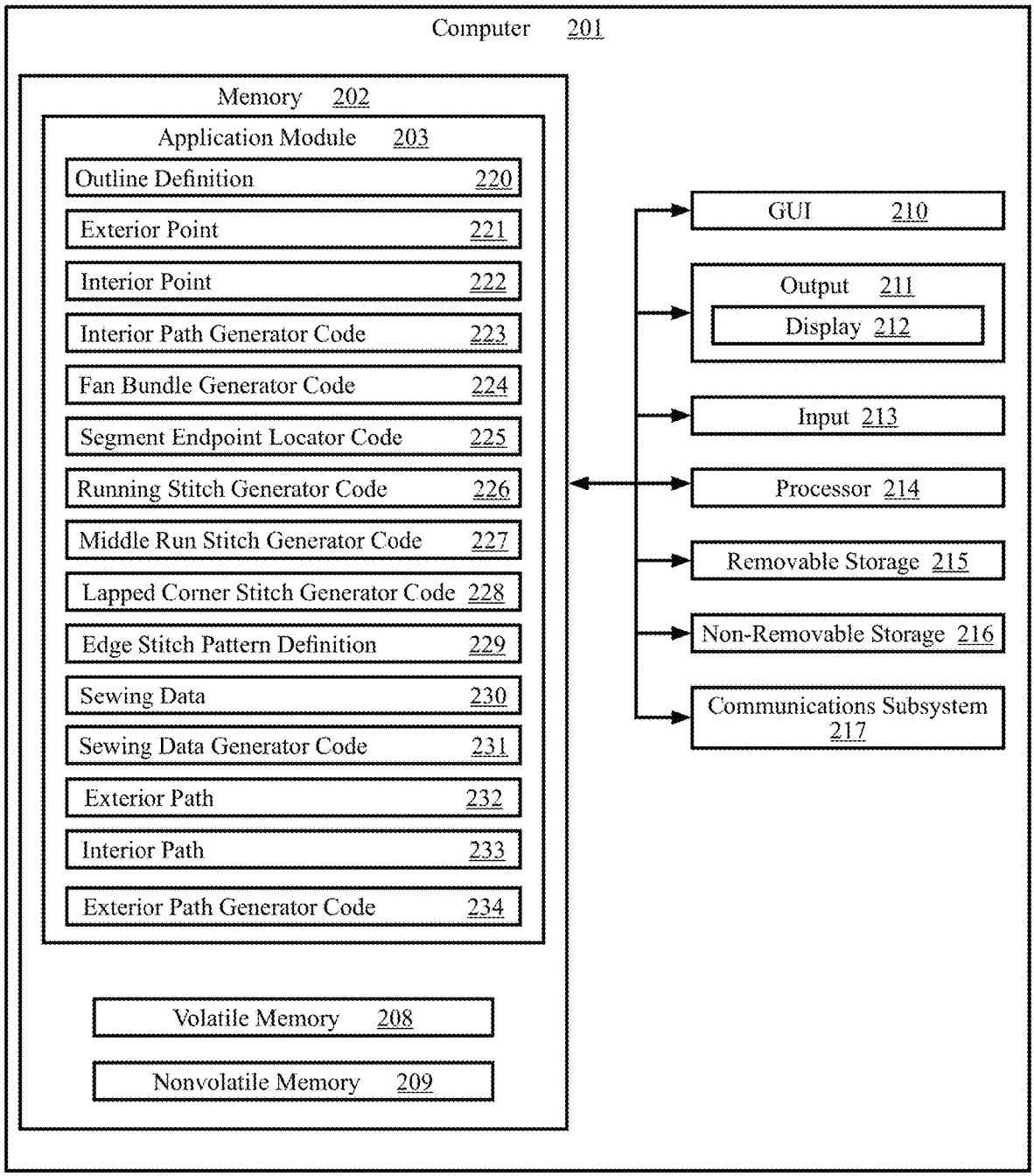
FIG. 2 is a high-level block diagram illustrating a computing system supporting systems and methods for producing simulated overlock stitching according to some aspects.

FIG. 2 is a high-level block diagram illustrating a computing system supporting systems and methods for producing simulated overlock stitching according to some aspects. A computing device in the form of a computer 201 configured to interface with controllers, peripheral devices, and other elements disclosed herein may include one or more processing units 214, memory 202, removable storage 215, and non-removable storage 216. Memory 202 may include volatile memory 208 and non-volatile memory 209. The computer 201 may include or have access to a computing environment that includes a variety of transitory and non-transitory computer-readable media such as volatile memory 208 and non-volatile memory 209, removable storage 215 and non-removable storage 216. Computer storage includes, for example, random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage, or other magnetic storage devices, or any other medium capable of storing computer-readable instructions as well as data including blockchain data, open public decentralized storage data, and computer code.

The computer 201 may include, or have access to, a computing environment that includes input 213, output 211, and a communications subsystem 217. The computer 201 may operate in a networked environment using a communications subsystem 217 to connect to one or more remote computers, remote sensors and/or controllers, detection devices, hand-held devices, multi-function devices (MFDs), speakers, mobile devices, tablet devices, mobile phones, Smartphone, or other such devices. The remote computer may also be a personal computer (PC), server, router, network PC, RFID enabled device, a peer device or other common network node, or the like. The communication connection may include a LAN, a WAN, Bluetooth connection, or other networks.

Output 211 is most commonly provided as a computer monitor, but may include any output device. Output 211 and/or input 213 may include a data collection apparatus associated with the computer 201. In addition, input 213, which commonly includes a computer keyboard and/or pointing device such as a computer mouse, computer track pad, touch screen, or the like, allows a user to select and instruct the computer 201. A user interface can be provided using output 211 and input 213. Output 211 may include a display 212 for displaying data and information for a user, or for interactively displaying a graphical user interface (GUI) 210. A GUI is typically responsive of user inputs entered through input 213 and typically displays images and data on display 212.

Note that the term "GUI" generally refers to a type of environment that represents programs, files, options, and so forth by means of graphically displayed icons, menus, and dialog boxes on a computer monitor screen or smart phone screen. A user can interact with the GUI to select and activate such options by directly touching the screen and/or pointing and clicking with a user input device 213 such as, for example, a pointing device such as a mouse, and/or with a keyboard. A particular item can function in the same manner to the user in all applications because the GUI provides standard software routines (e.g., the application module 203 can include program code in executable instructions, including such software routines) to handle these elements and report the user's actions.

Computer-readable instructions, for example, program code in application module 203, can include or be representative of software routines, software subroutines, software objects, etc. described herein, are stored on a computer-readable medium and are executable by the processor device (also called a processing unit) 214 of the computer 201. The application module 203 can include computer code such as interior path generator code 223, fan bundle generator code 224, segment endpoint locator code 225, running stitch generator code 226, middle run stitch generator code 227, lapped corner stitch generator code 228, and sewing data generator code 231. The application module can also store and generate data such as an outline definition 220, exterior points 221, interior points 222, exterior paths 232, interior paths 233, edge stitch pattern definitions 229, and sewing data 230. A hard drive, CD-ROM, RAM, Flash Memory, and a USB drive are just some examples of articles including a computer-readable medium. The exterior path generation code 234 can use an outline definition 220 to produce an exterior path 232 that includes a number of exterior points 221. The interior path generator code 223 can use the exterior path 232 to generate an interior path 233 that contains a number of interior points 222. The edge stitch pattern definition 229 can, initially, be the interior points interleaved with the exterior points. The edge stitch pattern definition 229 can be refined and added to such that the edge stitch pattern definition 229 specifies stitches that include cover stitches in fan shaped stitch bundles, running stitches, middle run stitches, lapped corner stitches, etc. The segment endpoint locator code 225 can use the interior point or the exterior points to locate segment endpoints. The fan bundle generator code 224 can use the interior point and the exterior points to generate stitch bundles that are fan shaped. The running stitch generator code 226 can add running stitches to the fan bundles. The middle run stitch generator code 227 can add middle run stitches to the fan bundles. The lapped corner stitch generator code 228 can use the exterior points, the interior points, and the segment endpoints to add lapped corner stitches to the edge stitch definitions. The sewing data generator code 231 can generate sewing data 230 from the edge stitch pattern definition 229. An embroidery machine can interpret the sewing data and thereby produce embroidery stitches on a substrate such as cloth or patch material. The embroidery stitches can include an edge stitch pattern specified by the edge stitch pattern definition 229. The embroidery stitches can also include decorative stitching in the interior of the patch. For example, a preexisting fill stitch definition can specify the decorative stitching while the edge stitch pattern definition 229 specifies the edge stitching. The sewing data can include the edge stitch pattern definition 229 appended to the fill stitch definition.

Figure 3:
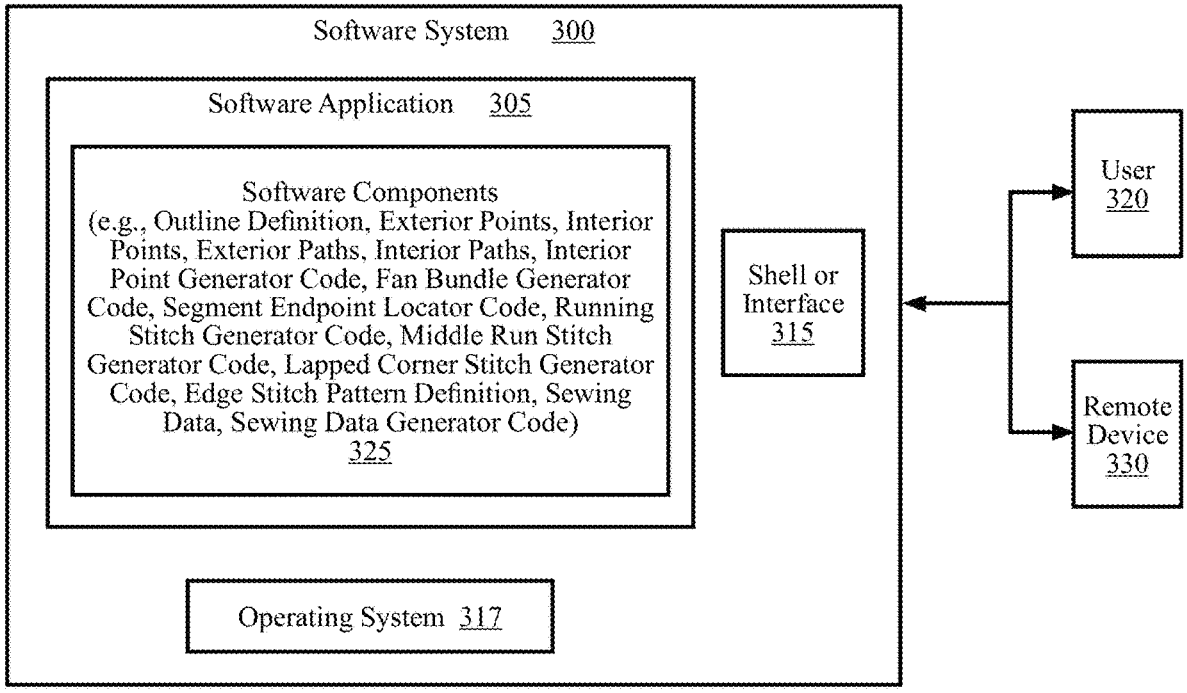
FIG. 3 is a high-level block diagram illustrating a software system supporting systems and methods for producing simulated overlock stitching according to some aspects.

FIG. 3 is a high-level block diagram illustrating a software system 300 supporting systems and methods for producing simulated overlock stitching according to some aspects. FIG. 2 illustrates a software system 300, which may be employed for directing the operation of the data-processing systems such as computer 201. Software applications 305, may be stored in memory 202, on removable storage 215, or on non-removable storage 216, and generally includes and/or is associated with a kernel or operating system 317 and a shell or interface 315. One or more application programs may be "loaded" (i.e., transferred from removable storage 215 or non-removable storage 216 into the memory 202) for execution by the computer 201. An application program 305 can include software components 325 such as software modules, software subroutines, software objects, network code, user application code, server code, UI code, outline definition, exterior points, interior points, exterior paths, interior paths, interior point generator code, fan bundle generator code, segment endpoint locator code, running stitch generator code, middle run stitch generator code, lapped corner stitch generator code, edge stitch pattern definition, sewing data, sewing data generator code, etc. The software system 300 can have multiple software applications each containing software components. The computer 201 can receive user commands and data through interface 315, which can include input 213, output 211, and communications connection 217 accessible by a user 320 or remote device 330. These inputs may then be acted upon by the computer 201 in accordance with instructions from operating system 310 and/or software application 305 and any software components 325 thereof.

Generally, software components 325 can include, but are not limited to, routines, subroutines, software applications, programs, objects, modules, objects (used in object-oriented programs), executable instructions, data structures, etc., that perform particular tasks or implement particular abstract data types and instructions. Moreover, those skilled in the art will appreciate that elements of the disclosed methods and systems may be practiced with other computer system configurations such as, for example, hand-held devices, mobile phones, smartphones, tablet devices, multi-processor systems, microcontrollers, printers, copiers, fax machines, multi-function devices, data networks, microprocessor-based or programmable consumer electronics, networked personal computers, minicomputers, mainframe computers, servers, medical equipment, medical devices, and the like.

Note that the terms "component" and "module" as utilized herein may refer to one of or a collection of routines and data structures that perform a particular task or implement a particular abstract data type. Applications and components may be composed of two parts: an interface, which lists the constants, data types, variables, and routines that can be accessed by other modules or routines; and an implementation, which is typically private (accessible only from within the application or component) and which includes source code that actually implements the routines in the application or component. The terms application or component may also simply refer to an application such as a computer program designed to assist in the performance of a specific task such as word processing, accounting, inventory management. Components can be built or realized as special purpose hardware components designed to equivalently assist in the performance of a task.

The interface 315 can include a graphical user interface 210 that can display results, whereupon a user 320 or remote device 330 may supply additional inputs or terminate a particular session. In some embodiments, operating system 310 and GUI 210 can be implemented in the context of a "windows" system. It can be appreciated, of course, that other types of systems are possible. For example, rather than a traditional "windows" system, other operating systems such as, for example, a real-time operating system (RTOS) more commonly employed in wireless systems may also be employed with respect to operating system 310 and interface 315. The software application 305 can include, for example, software components 325, which can include instructions for carrying out steps or logical operations such as those shown and described herein.

The description herein is presented with respect to embodiments that can be embodied in the context of, or require the use of, a data-processing system such as computer 201, in conjunction with program code in an application module 203 in memory 202, software system 300, or computer 201. The disclosed embodiments, however, are not limited to any particular application or any particular environment. Instead, those skilled in the art will find that the system and method of the embodiments may be advantageously applied to a variety of system and application software including database management systems, word processors, and the like. Moreover, the embodiments may be embodied on a variety of different platforms including Windows, Macintosh, UNIX, LINUX, Android, Arduino, and the like. Therefore, the descriptions of the exemplary embodiments, which follow, are for purposes of illustration and not considered a limitation.

Figure 4:
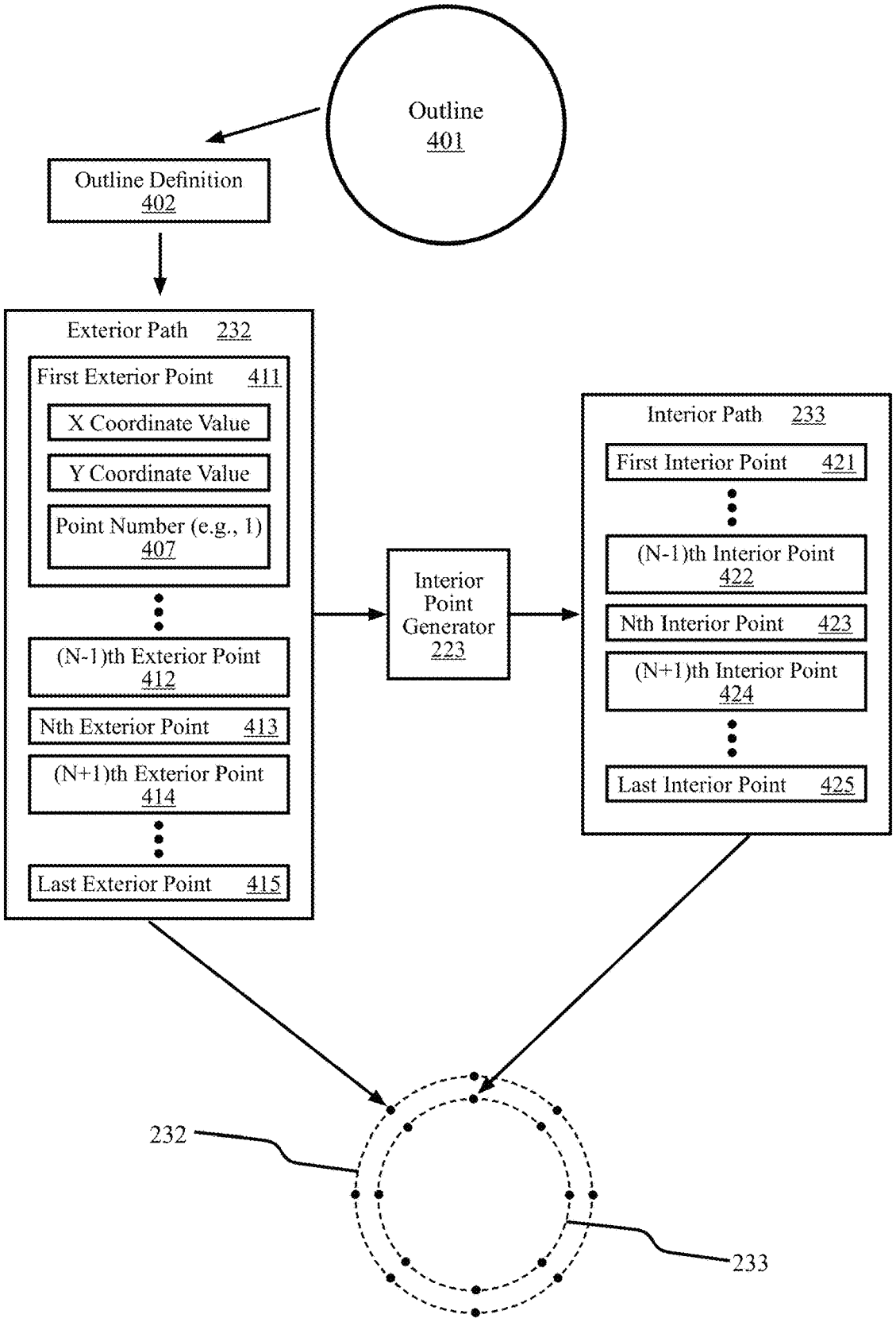
FIG. 4 is a high-level block diagram illustrating using an outline definition to determine exterior points and interior points according to some aspects.

FIG. 4 is a high-level block diagram illustrating using an outline definition 402 to determine exterior points 221 and interior points 222 according to some aspects. The outline of an object can be received. The outline can be represented as one or more curves, a series of points, a vector image (e.g., svg file or other vector file format), a curved line in a raster image, etc. The exterior path 232 can be generated by placing points, the exterior points, at a regular spacing around the outline 401 specified by the outline definition 402. The regular spacing can be referred to as the stitch density for example, a stitch density of 0.3 mm indicates that the spacing between the exterior points is 0.3 mm. The edge stitch width is a sewing parameter that indicates the distance from the exterior path to the interior path. The interior path is inside the exterior path. An interior point may be determined for each exterior point. For example, a point on the interior path that is closest to an exterior point may be set as an interior point. The interior path may be defined by the interior points after the interior points are identified. The interior point generator can generate the interior path 233 from the exterior path 232.

An alternative is to use the outline 401 to define an interior path. For example, the interior path can be inside the outline 401 and separated from the outline by the edge stitch width. The interior points, spaced apart by the stitch density, may be placed on the interior path. Afterward, the interior points may be used to determine the locations of the exterior points on the exterior path. The interior path 323 may be considered to be specified by the interior points after the interior points are determined. The stitch width and the stitch density are sewing parameters that can have default values, can be set by a user, or otherwise provided to the system.

The exterior path 232 may be considered to be specified by the exterior points after the exterior points are determined. The exterior path 232 is shown as specified by a first exterior point 411, a last exterior point 415, and all the exterior points between the first exterior point 411, and the last exterior point 415. The exterior points between the first exterior point 411, and the last exterior point 415 can include a (N−1)th exterior point 412, a Nth exterior point 413, and a (N+1)th exterior point 414. The interior path 233 may be considered to be specified by the interior points after the interior points are determined. The interior path 233 is shown as specified by a first interior point 421, a last interior point 425, and all the interior points between the first interior point 421, and the last interior point 425. The interior points between the first interior point 421, and the last interior point 425 can include a (N−1)th interior point 422, a Nth interior point 423, and a (N+1)th interior point 424. Points such as interior points and exterior points can be specified by an X coordinate value and a Y coordinate value.

Figure 5:
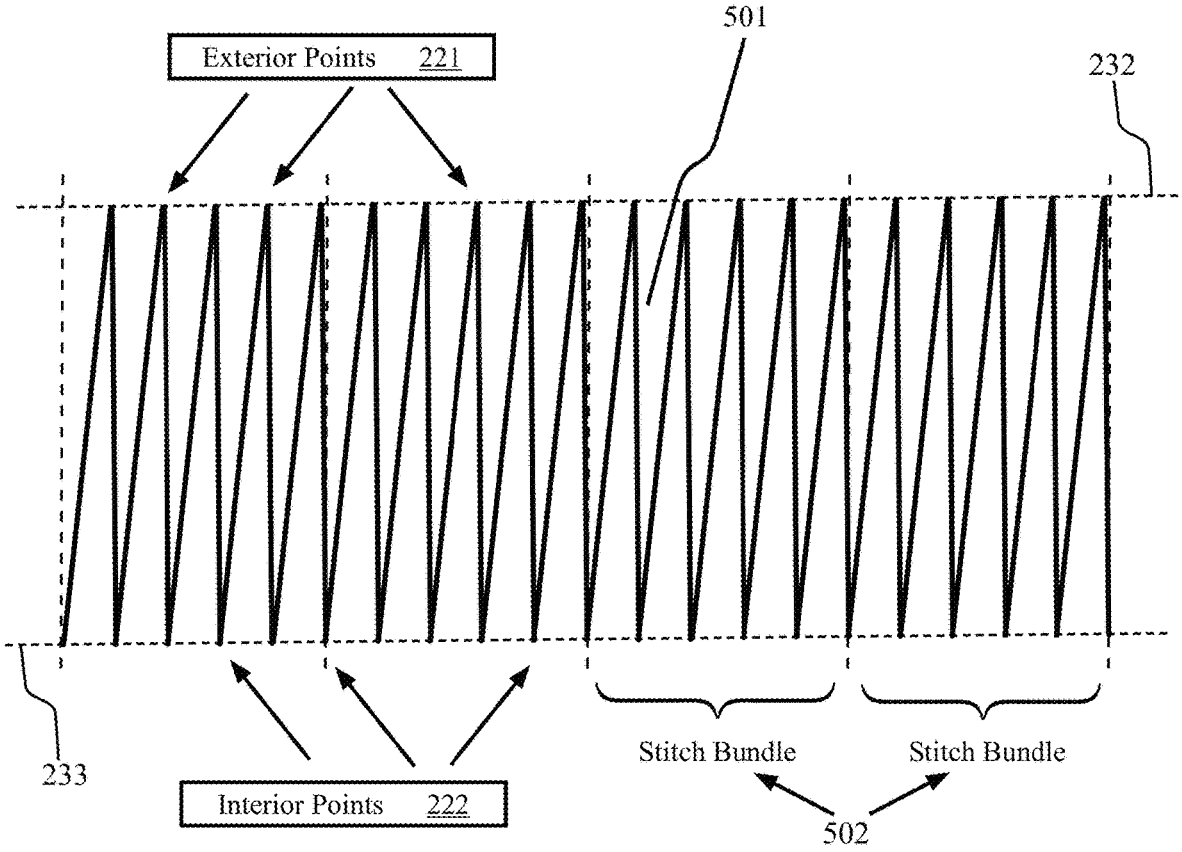
FIG. 5 is a diagram illustrating exterior points and interior points for cover stitches according to some aspects. Here, a satin stitch is used for the cover stitches.

FIG. 5 is a diagram illustrating exterior points 221 and interior points 222 for cover stitches 501 according to some aspects. Here, a satin stitch is used for the cover stitches 501. The cover stitches are within an edge area between the exterior path and the interior path. Satin stitches are notoriously well known and understood in the arts of embroidery and embroidery software. The cover stitches pass from the exterior points 221 exterior path 232 to the interior points 222 on the interior path 233. An edge stitch pattern definition for the cover stitch illustrated in FIG. 5 can be generated by interleaving the interior points 222 with the exterior points 221. Each stitch is specified by one interior point and one exterior point. For example, the Nth exterior point 413 and the Nth interior point 423 can specify a cover stitch in the edge stitch pattern. The Nth interior point 423 and the (N+1)th exterior point 414 can specify the next cover stitch in the edge stitch pattern. The edge stitch pattern definition can be into stitch bundle definitions that specify a series of stitch bundles 502 in the edge stitch pattern. For example, if the stitch bundle length is 1.7 mm then the edge stitch pattern can be split into sections that are 1.7 mm long and the cover stitches in each section are grouped into one of the stitch bundles 50.

FIG. 6 is a diagram illustrating increasing the intra-bundle spacing of outside edge stitch points according to some aspects. The exterior points 221 can specify the outside edge stitch points for the edge stitch pattern. The intra-bundle spacing is the spacing between the outside edge stitch points within a bundle. The initial spacing 601 between the outside edge stitch points may equal the edge stitch density. The intra-bundle spacing can be increased. For example, the initial spacing may be 0.3 mm and the final spacing may be 0.5 mm. The rightmost exterior point of the stitch bundle illustrated in FIG. 6 is shown remaining in place while the rest of the edge points are moved along the exterior path such that the intra-bundle spacing is the spacing between the outside edge stitch points within a bundle is final spacing. The stitch bundles are now beginning to appear fan shaped. Fan shaped means that the stitch bundle is narrower along the interior path than on the exterior path.

Figure 7:
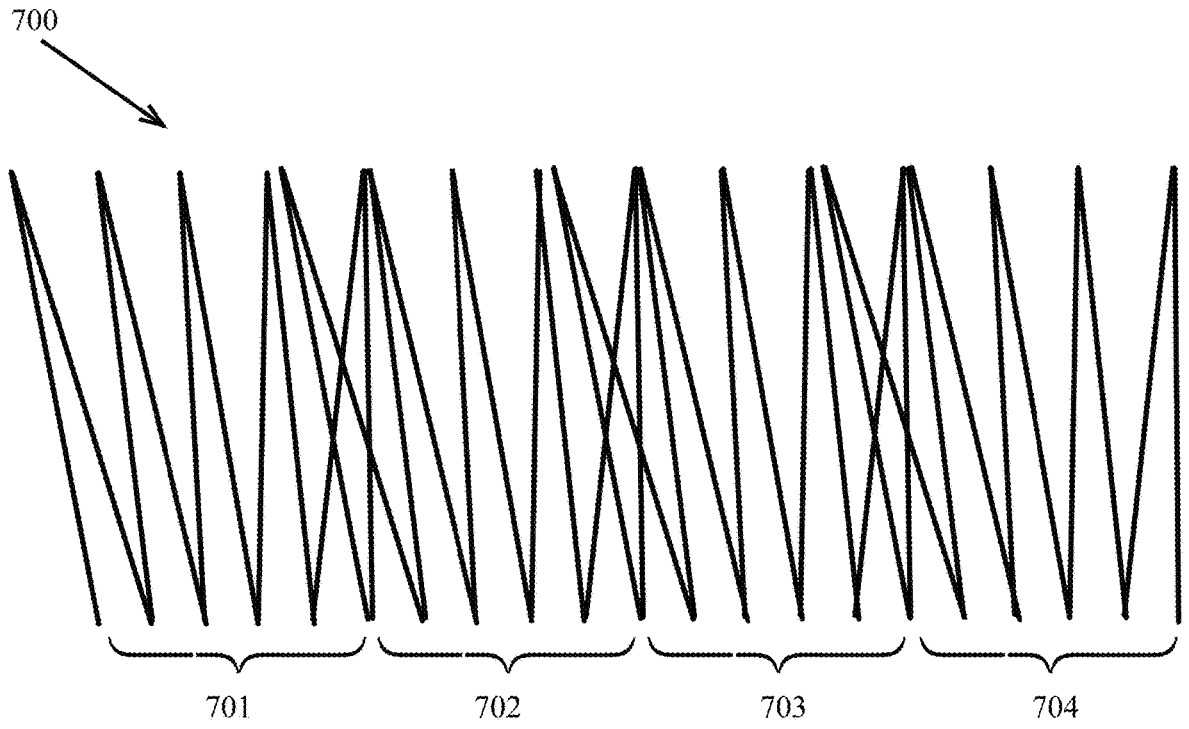
FIG. 7 is a diagram illustrating the stitch bundles of FIG. 5 after the intra-bundle spacing of the outside edge stitch points is increased to a final spacing according to some aspects.

FIG. 7 is a diagram illustrating the stitch bundles 502 of FIG. 5 after the intra-bundle spacing of the outside edge stitch points is increased to a final spacing 602 according to some aspects. The illustrated portion of the outside edge stitch pattern 700 includes a first stitch bundle 701 a second stitch bundle 702, a third stitch bundle 703 and a fourth stitch bundle 704.

Figure 8:
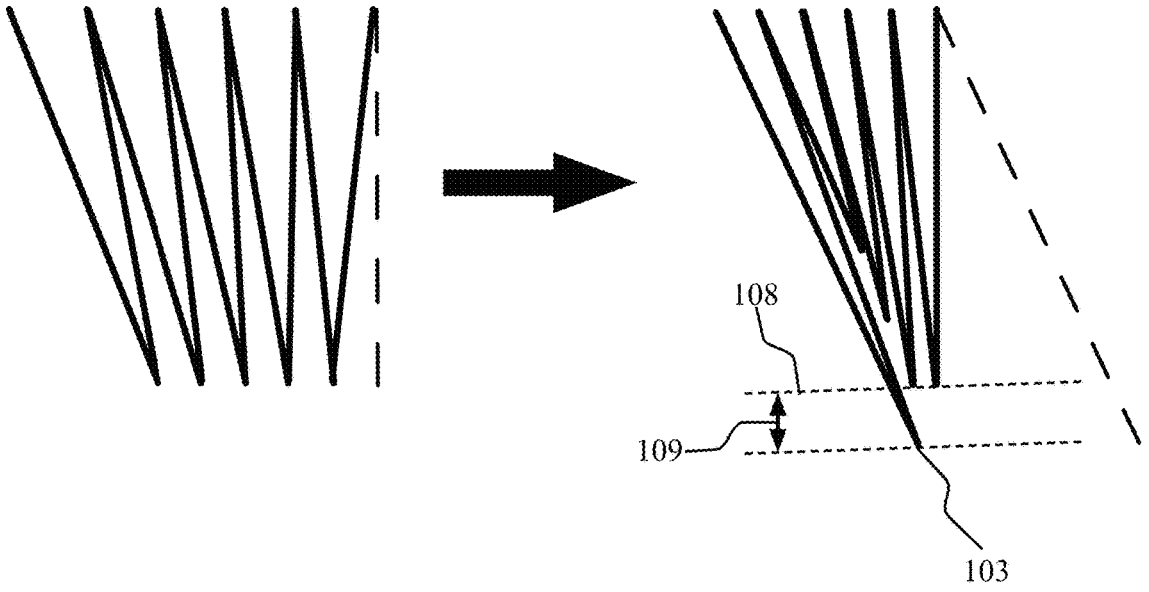
FIG. 8 is a diagram illustrating decreasing the intra-bundle spacing of the inside edge stitch points according to some aspects.

FIG. 8 is a diagram illustrating decreasing the intra-bundle spacing of the inside edge stitch points along the inside edge according to some aspects. The inside edge stitch points are gathered into a space that is approximately twice the initial spacing 601. Such close spacing along a line is untenable because each stitch point indicates a needle penetration where a stitch enters the underlying fabric. As such, some of the inside edge stitch points are also spaced away from the interior path. As illustrated, the first and second inside edge stitch points remain on the interior path. The third inside edge stitch point is above the interior path by the extension distance 109. The fourth inside edge stitch point is above the interior path by twice the extension distance 109. Here, the extension distance is used for specifying the inside edge offsets of the third and fourth inside edge stitch point. A different value may be used such as a specific sewing parameter (e.g., the inside edge offset) that may be set by the user, may have a default value, may default to the extension distance, etc. The fifth interior edge stitch point is the extended point 103 of the stitch bundle. The extended point can be positioned below the second inside edge stitch point. The extended point can be positioned away from the interior edge by a predetermined extension distance. The predetermined extension distance which is a sewing parameter that may be set by the user, may have a default value, etc.

Figure 9:
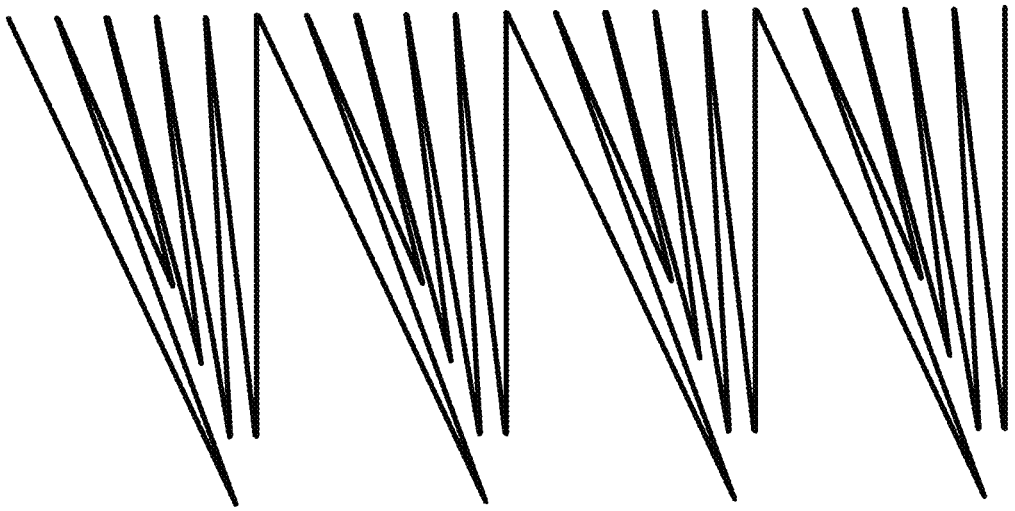
FIG. 9 is a diagram illustrating the stitch bundles of FIG. 7 after the intra-bundle spacing of the inside edge stitch points is decreased to a final spacing according to some aspects.

FIG. 9 is a diagram illustrating the stitch bundles 502 of FIG. 5 and FIG. 7 after the intra-bundle spacing of the inside edge stitch points is decreased to a final spacing according to some aspects. These stitch bundles are fan shaped. The edge stitch pattern now includes a series of fan shaped stitch bundles. In the example of FIG. 9, none of the stitch bundles include more than one extended stitch.

Figure 10:
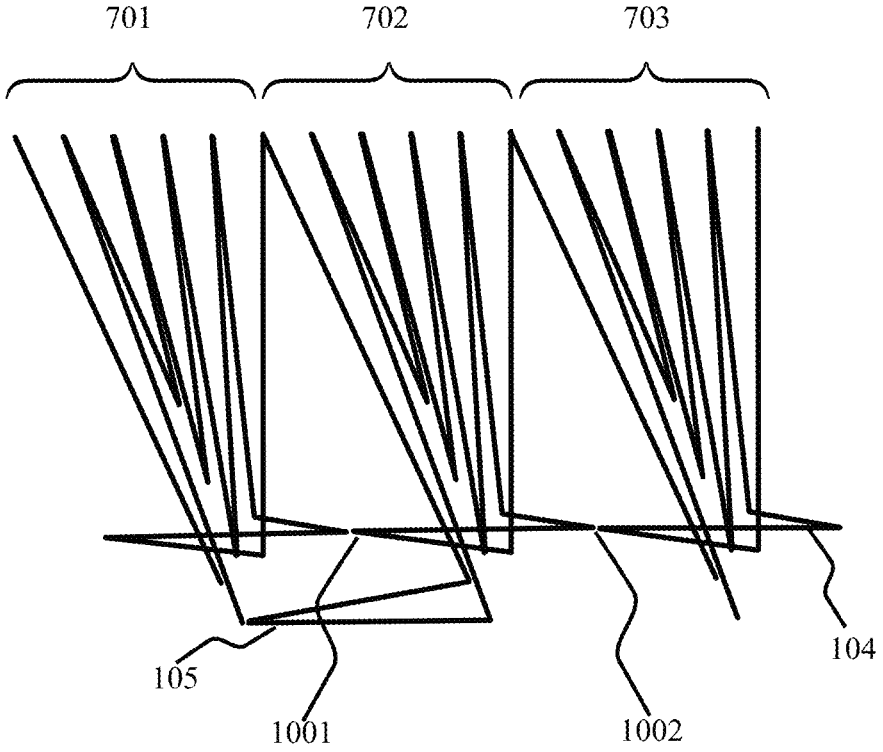
FIG. 10 is a diagram illustrating running stitches and middle run stitches added to the stitch bundles of FIG. 9 according to some aspects.

FIG. 10 is a diagram illustrating running stitches 104 and middle run stitches 105 added to three of the stitch bundles of FIG. 9 according to some aspects. The middle run stitches are illustrated as following the first cover stitch (the rightmost cover stitch). The second cover stitch is illustrated as following the middle run cover stitch. Three middle run stitches can be added to the stitch bundle to thereby produce the middle run stitch points. Looking at the second stitch bundle 702, the first middle run stitch goes left from the end of the first cover stitch to a first middle run point 1001. A second middle run stitch point goes right from the first middle run point 1001 to a second middle run point 1002. The third middle run stitch goes left from the second middle run point to where the first middle run stitch began. The second cover stitch follows the third middle run stitch. It is common to avoid having two needle insertions at the same point when generating sewing data for embroidery patterns. As such, the third middle run stitch may end at a point that is slightly offset from the point where the first middle run stitch begins. The point at which the second cover stitch begins can be close enough (e.g., within 0.1 mm) to the point where the first cover stitch ends that the cover stitches appear to have been sewn one after the other.

The running stitches 104 may be added to the stitch bundle immediately before the last cover stitch (the leftmost cover stitch) of the bundle. In the example illustrated in FIG. 10, the last cover stitch is the tenth cover stitch in a stitch bundle. The next-to-last cover stitch in the stitch bundle is the ninth cover stitch. Here, the middle run stitches aren't being counted as cover stitches. The ninth cover stitch ends at the extended point 103. The first one of the running stitches is illustrated as going from the extended point of the second stitch bundle 702 to the extended point of an adjacent stitch bundle 701. The second one of the running stitches goes back to where the first running stitch began. It is common to avoid having two needle insertions at the same point when generating sewing data for embroidery patterns. As such, the second running stitch may end at a point that is slightly offset from the point where the first running stitch begins. The point at which the last cover stitch begins can be close enough (e.g., within 0.1 mm) to the point where the next-to-last cover stitch ends that the cover stitches appear to have been sewn one after the other.

The edge stitch pattern can be sewn by sewing each stitch bundle one after the another in sequence. As such, the second stitch bundle 702 may be sewn after the first stitch bundle 701 is sewn. The third stitch bundle 703 can be sewn after the second stitch bundle 702 is sewn. As such, the middle run stitches and running stitches of the second stitch bundle are sewn after the first stitch bundle is sewn and before the third stitch bundle is sewn.

Figure 11:
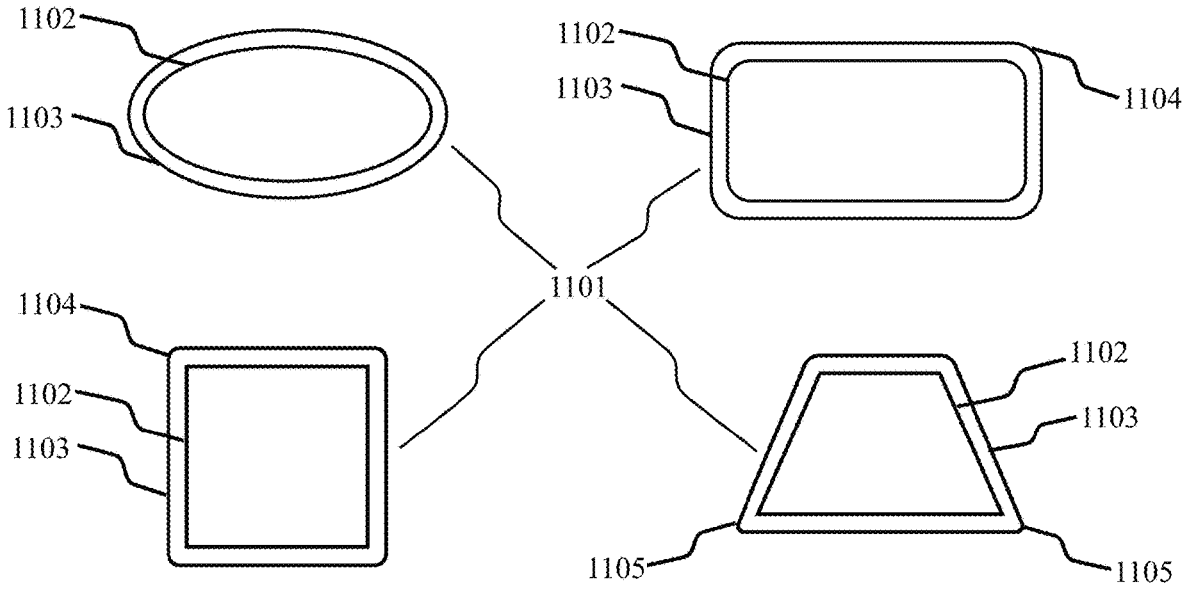
FIG. 11 is a diagram illustrating typical patch shapes according to some aspects.

FIG. 11 is a diagram illustrating typical patch shapes 1101 according to some aspects. Each of the patch shapes has an outside edge 1103. The outside edge can be used to determine an inside edge 1102. For example, the inside edge can be a closed curve that is inside the outside edge and that is spaced from the outside edge by the edge stitch width. As discussed above the exterior path may lie along the outside edge and the interior path may lie along the inside edge. Also as discussed above, an overlay machine is unable to sew corners that are sharper than a certain angle. For example, an overlook may be able to continuously sew rounded ninety-degree angles 1104 of rectangular and square patch shapes. The overlock machine may be unable to continuously sew overlock stitching on the sharp corners 1105 of a trapezoidal patch. At such corners, the overlock stitching is sewn off the patch, thereby ending a segment of the overlock stitching. The patch is then turned and a new segment of overlock stitching is begun where the previous section ended. In order to simulate overlock stitching at sharp corners, the stopping and starting of sections of overlock stitching must be simulated.

Figure 12:
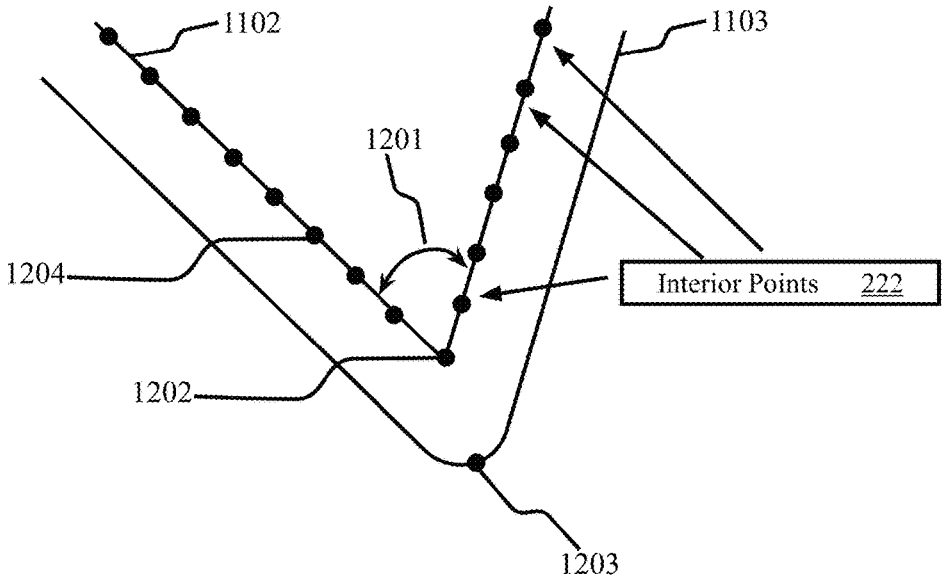
FIG. 12 is a diagram illustrating a divergence angle at a divergence point according to some aspects.

FIG. 12 is a diagram illustrating a divergence angle 1201 at a divergence point 1202 according to some aspects. An edge angle can be calculated at each interior point 222 and then compared to a threshold edge angle to determine if the interior point is a divergence point. Two vectors can begin at each interior point. The first one of the vectors can go from the interior point to the preceding interior point. The second one of the vectors can go from the interior point to the subsequent interior point. The angle between the two vectors is the edge angle at that interior point. An interior point is a divergence point 1202 when the edge angle 1201 at that interior point is less than a threshold edge angle. The threshold edge angle can be a sewing parameter entered by the user, a default value, etc. The threshold edge angle indicates an angle at which a segment of overlock stitching would end and another begin because of the patch shape and the limitations of overlock machines. The edge angle at one of the interior points 1204 is 180 because vectors to the adjacent interior points intersect and 180 degrees. The edge angle at a specific interior point may be determined using interior points that are further away than the adjacent interior points. For example, the vectors may be required to be at least as long as the edge stitch width and the shortest vectors meeting that criterion may be used for determining the edge angles. The divergence point may be used to identify a segment endpoint. As discussed above, an edge stitch pattern definition can be produced by interleaving the exterior points and the interior points. The segment endpoint may be one of the exterior points that defines a cover stitch with the divergence point. A cover stitch can be defined by two points, one an interior point and the other an exterior point. As such, the divergence point is the endpoint of two stitches. The exterior point for the longer of those two stitches may be selected as the segment endpoint 1203.

Figure 13A:
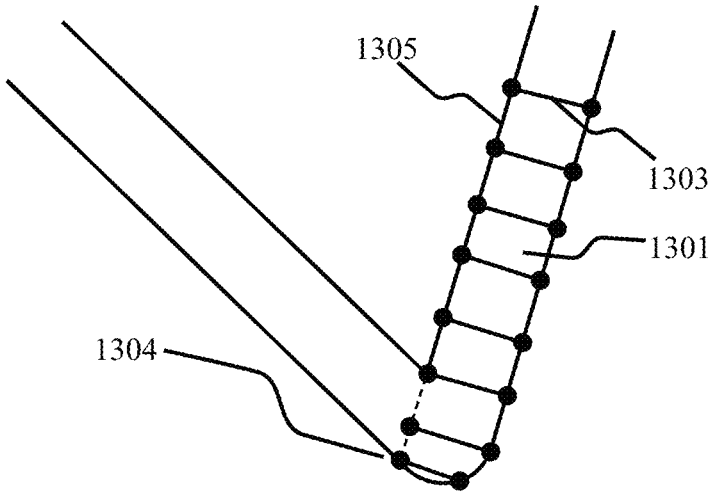
FIG. 13A and FIG. 13B are diagrams illustrating a first end segment and a second end segment that meet at a segment endpoint according to some aspects.
Figure 13B:
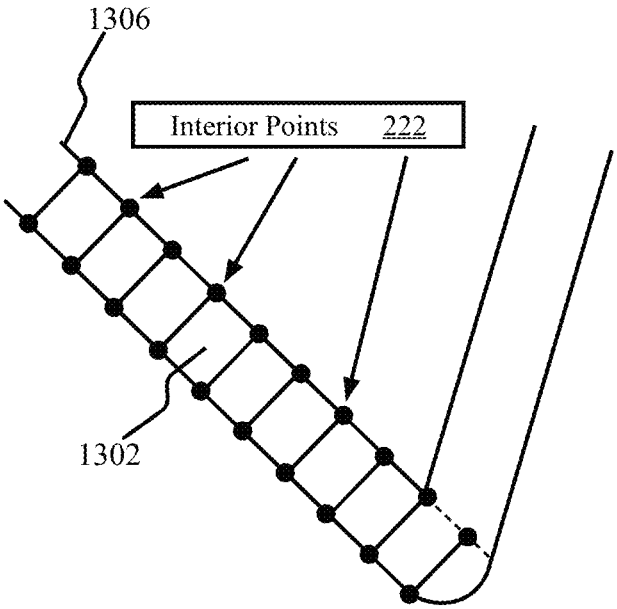

FIG. 13A and FIG. 13B are diagrams illustrating a first end segment 1301 and a second end segment 1302 that meet at a segment endpoint 1203 according to some aspects. The interior path has been split at the divergence point and the exterior path has been split at the segment endpoint 1203. Splitting the interior path and the exterior path creates two end segments, the first end segment 1301 and the second end segment 1302. The inside edges of the end segments are extended past the divergence point until they meet the exterior path. The first segment interior path 1305 is the inside edge of the first end segment 1301. The second end segment interior path 1306 is the inside edge of the second end segment 1302. Interior points are added along the first segment interior path 1305 and the second end segment interior path 1306. Exterior points may be added along the end segments to thereby define cover stitches that cover the end segments. With respect to the edge stitch pattern definition, additional cover stitches have been added in the area where the end segments intersect.

Figure 14:
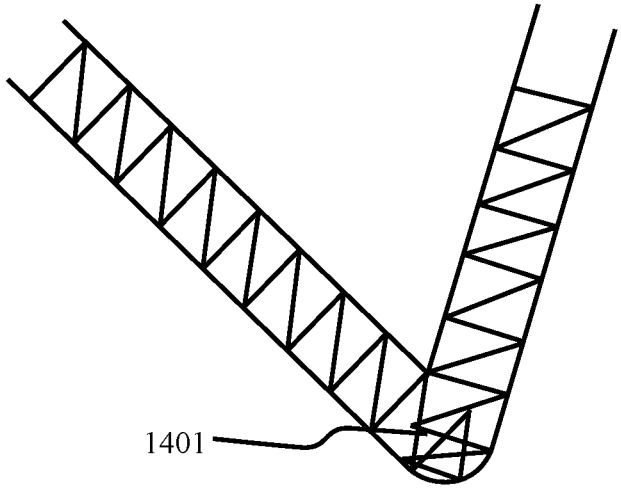
FIG. 14 is a diagram illustrating lapped corner stitches where two end segments overlap according to some aspects.

FIG. 14 is a diagram illustrating lapped corner stitches 1401 where two end segments 1301, 1302 overlap according to some aspects. An embroidery machine sewing the edge stitch pattern defined by the edge stitch pattern definition may sew the first end segment 1301 and then immediately sew the second end segment. The lapped corner stitches are the stitches of one segment that overlap the stitches of the other segment. A lapped corner is formed by the lapped corner stitches.

Figure 15:
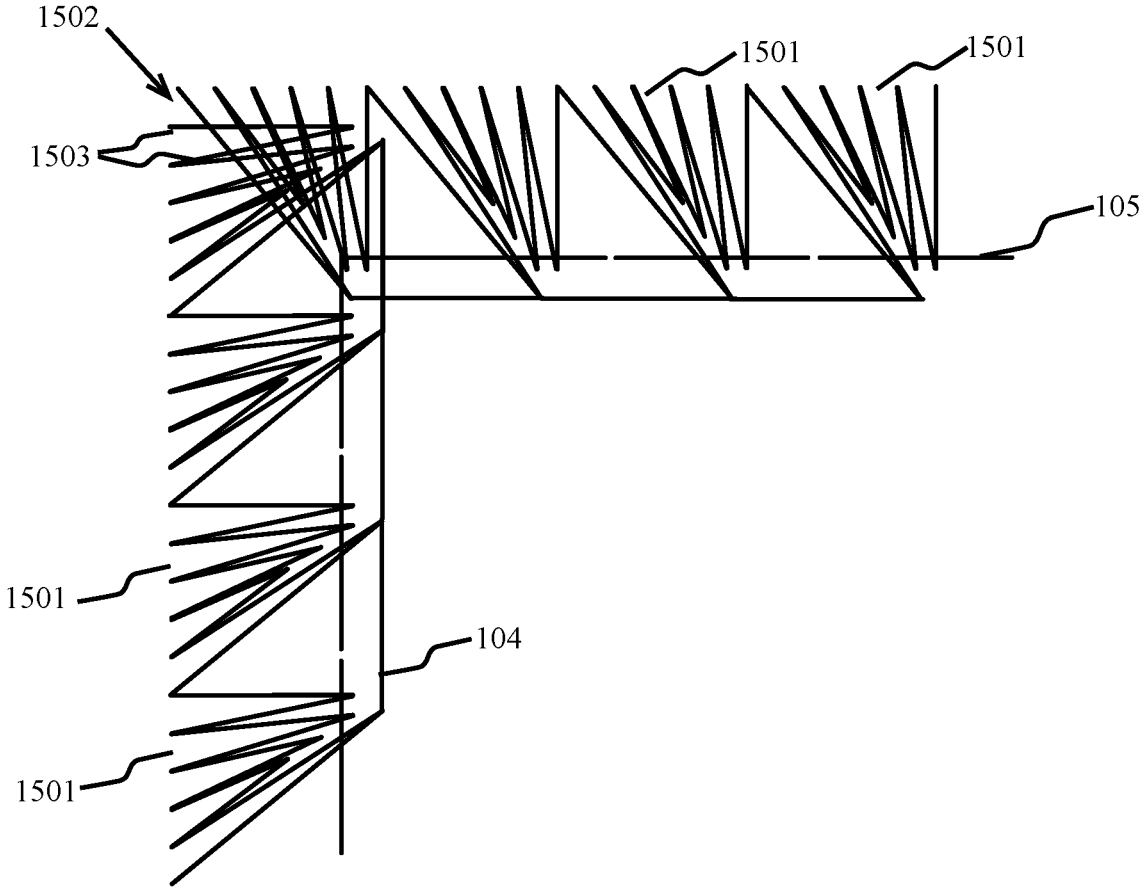
FIG. 15 is a diagram illustrating an edge stitch pattern that includes edge stitches that are arranged as stitch bundles that are fan shaped and that have lapped corner stitches where two end segments overlap according to some aspects.
Figure 16:
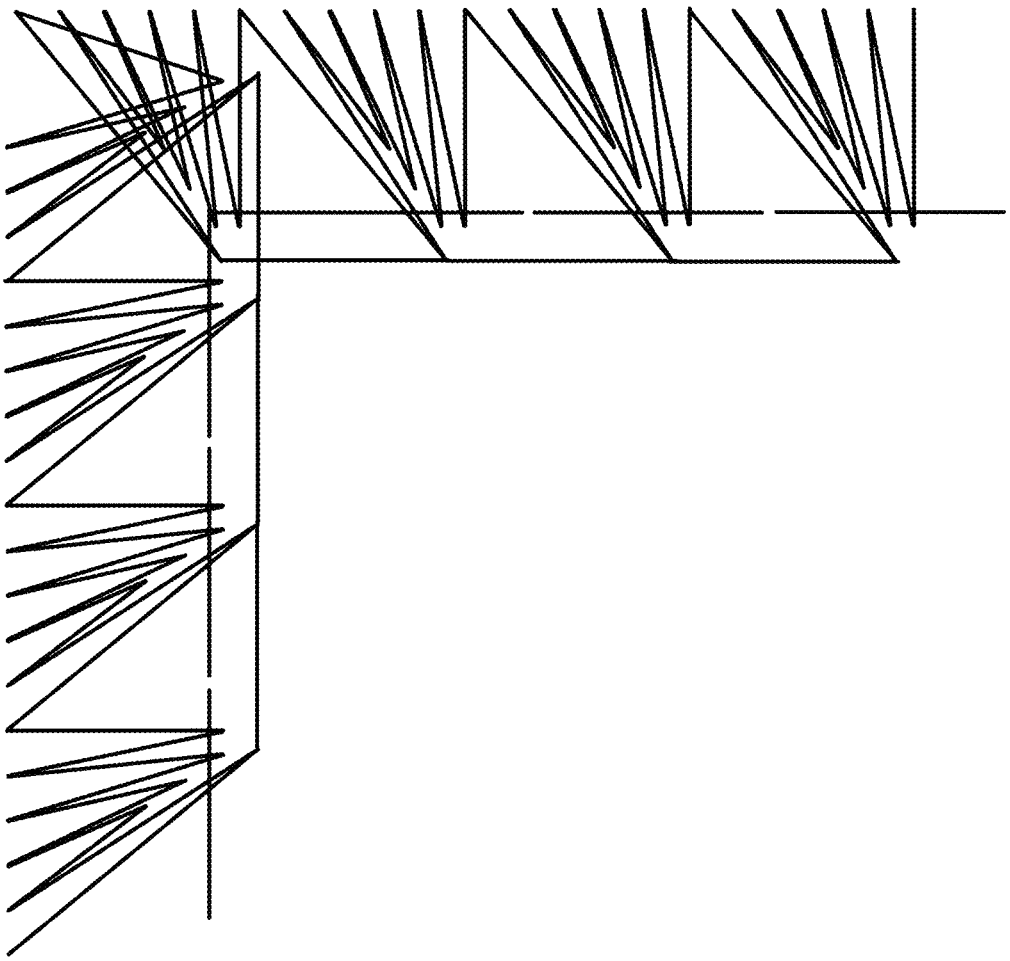
FIG. 16 is a diagram illustrating two overlapping corner stitches removed from the edge stitch pattern illustrated in FIG. 15 according to some aspects.

FIG. 15 is a diagram illustrating an edge stitch pattern that includes edge stitches that are arranged as stitch bundles 1501 that are fan shaped and that have lapped corner stitches 1502 where two end segments overlap according to some aspects. The edge stitch pattern illustrated in FIG. has running stitches 104 and the middle run stitches 105. The lapped corner formed by the lapped corner stitches 1502 has a number of overlapping corner stitches 1503. The overlapping corner stitches are the stitches of one segment that overlap stitches of the other segment. One or more of the overlapping corner stitches can be excluded from the edge stitch pattern to thereby reduce the thickness at the lapped corner relative to a lapped corner where all of the lapping corner stitches are sewn. The overlapping corner stitches can be excluded by adjusting the edge stitch pattern definition. For example, the stitch definitions for some of the overlapping corner stitches can be removed from the edge stitch pattern definition. The lapping corner stitches to be removed may be selected as, for example, the lapping corner stitches of the first end segment that overlaps a stitch of the second end segment within a specified distance from the stitch's exterior point (e.g., within 20% of the stitch length). FIG. 16 is a diagram illustrating two overlapping corner stitches removed from the edge stitch pattern illustrated in FIG. 15 according to some aspects. The middle run stitches are shown parallel to running stitches and to the exterior path.

Figure 17:
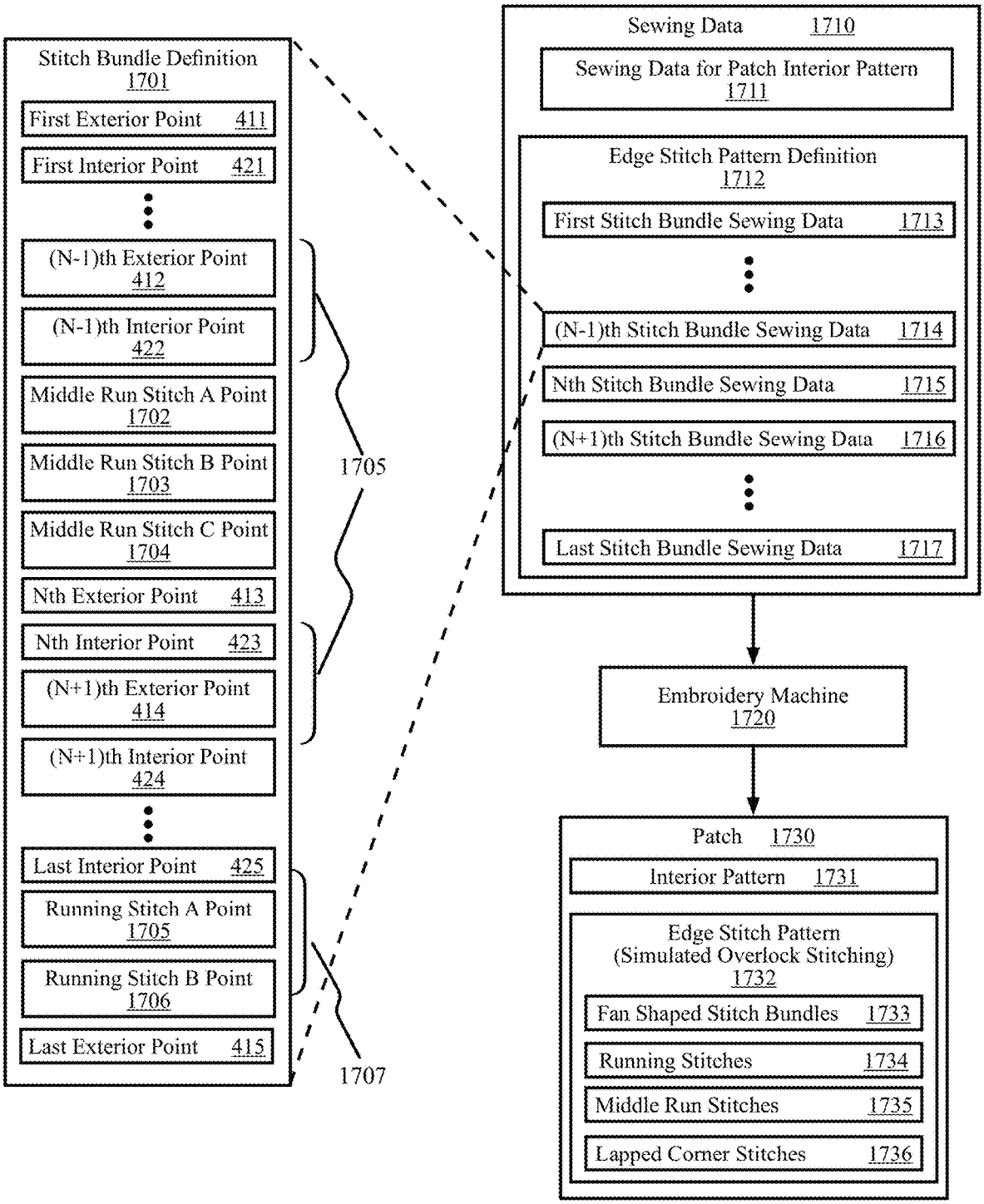
FIG. 17 is a high-level conceptual diagram illustrating sewing data used for producing a patch that has simulated overlock stitching according to some aspects.

FIG. 17 is a high-level conceptual diagram illustrating sewing data used for producing a patch that has simulated overlock stitching according to some aspects. A stitch bundle definition 1701 can include interior points interleaved with exterior points to thereby define cover stitches. An exterior point and the immediately following interior point define a cover stitch. An interior point and the immediately following exterior point also define a cover stitch. As such, one cover stitch definition 1705 in the stitch bundle definition is the (N−1)th exterior point 412 and the (N−1)th interior point 422 that immediately follows. Another cover stitch definition 1705 in the stitch bundle definition is the (N−1)th exterior point 412 and the (N−1)th interior point 422 that immediately follows. The middle run stitching can be seen following the (N−1)th interior point 422. Middle run stitch A point 1702 can be for the first middle run point 1001. Middle run stitch B point 1703 can be for the second middle run point 1002. Middle run stitch C point 1704 can be for a point on or near the (N−1)th interior point 422, which is where the first middle run stitch began. The running stitches have been added before the last cover stitch. Running stitch point A 1705 can be on or near the last interior point of an adjacent stitch bundle. Running stitch point B 1706 can be on or near the last interior point 425 of the stitch bundle definition 1701. In the example of FIG. 17, the extended stitch definition 1707 includes the last interior point 425, running stitch point A 1705, and running stitch point B 1706. Before the running stitch definition is added, the last cover stitch definition includes the last exterior point 415 and the last interior point 425. After the running stitch definition is added, the last cover stitch definition includes running stitch point B 1706 and the last exterior point 415.

The sewing data 1710 can include sewing data for the patch interior pattern 1711 and an edge stitch pattern definition 1712. The edge stitch pattern can include sewing data for numerous stitch bundles such as the first stitch sewing data 1713 the (N−1)th stitch sewing data 1714, the Nth stitch sewing data 1715, the (N+1)th stitch sewing data 1716, and the last stitch sewing data 1717. An embroidery machine 1720 can use the sewing data 1710 to produce a patch 1730 that has an interior pattern 1731 and an edge stitch pattern 1732. The embroidery machine 1720 can use the sewing data for the patch interior pattern 1711 to produce the interior pattern 1731. The embroidery machine 1720 can use the edge stitch pattern definition 1712 to produce the edge stitch pattern 1732. The edge stitch pattern 1732 can be simulated overlock stitching that includes fan shaped bundles 1733, running stitches 1734, middle run stitches 1735, and lapped corner stitches 1736. For simplicity of presentation, the stitch bundles in the edge stitch pattern are illustrated as separate blocks. In practice, the last point (e.g., last exterior point 415) of one stitch bundle is the first point (e.g., first exterior point 411) of the subsequent stitch bundle.

Figure 18:
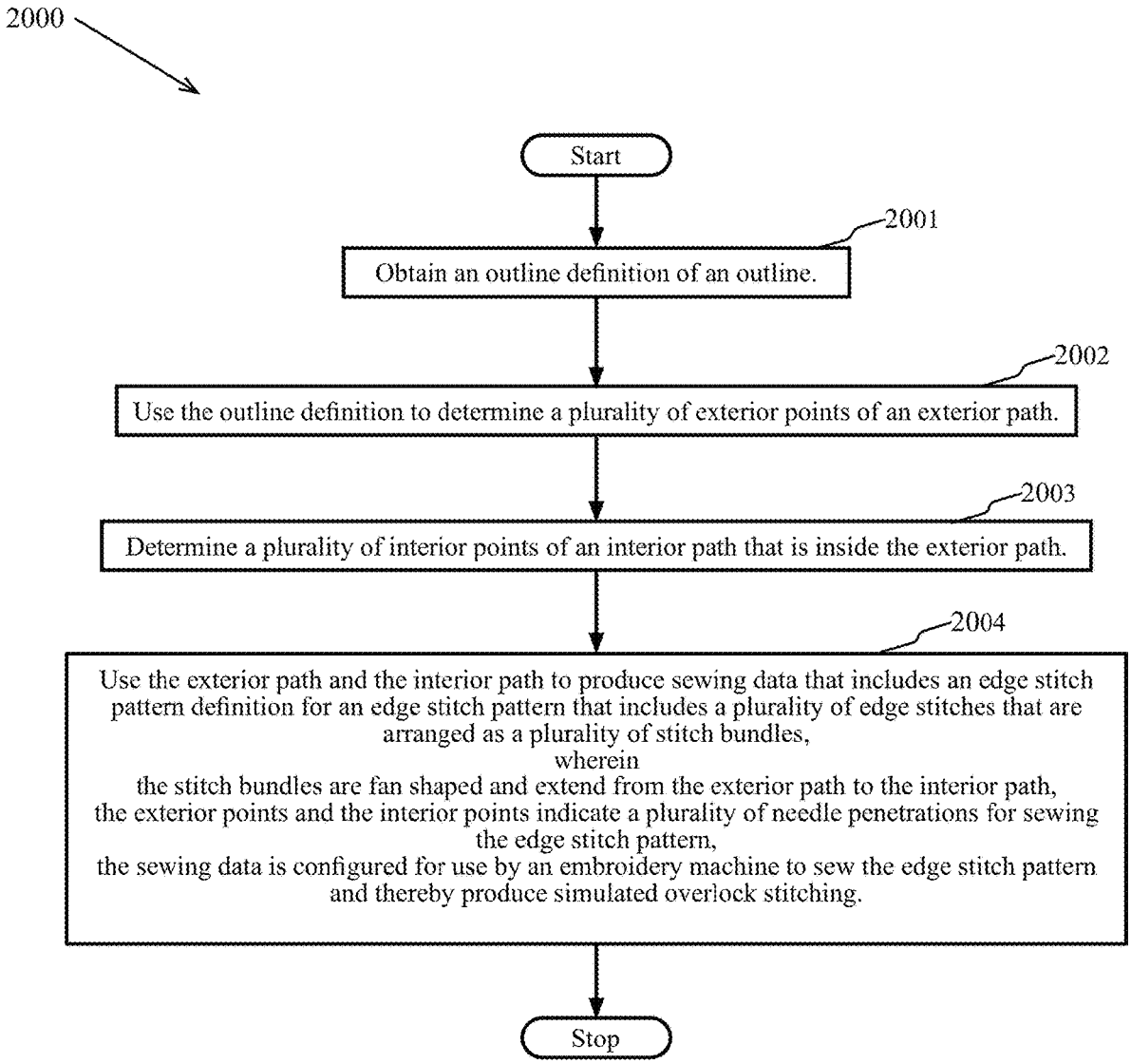
FIG. 18 is a high-level flow diagram illustrating a method for producing patches that have simulated overlock stitching according to some aspects.

FIG. 18 is a high-level flow diagram illustrating a method for producing patches that have simulated overlock stitching 2000 according to some aspects. After the start, at block 2001 the method can obtain an outline definition of an outline. At block 2002, the method can use the outline definition to determine a plurality of exterior points of an exterior path. At block 2003, the method can determine a plurality of interior points of an interior path that is inside the exterior path. At block 2004, the method can use the exterior path and the interior path to produce sewing data that includes an edge stitch pattern definition for an edge stitch pattern that includes a plurality of edge stitches that are arranged as a plurality of stitch bundles, wherein the stitch bundles are fan shaped and extend from the exterior path to the interior path, the exterior points and the interior points indicate a plurality of needle penetrations for sewing the edge stitch pattern, the sewing data is configured for use by an embroidery machine to sew the edge stitch pattern and thereby produce simulated overlock stitching.

Although the operations of the method(s) herein are shown and described in a particular order, the order of the operations of each method may be altered so that certain operations may be performed in an inverse order or so that certain operations may be performed, at least in part, concurrently with other operations. Instructions or sub-operations of distinct operations may be implemented in an intermittent and/or alternating manner.

It should also be noted that at least some of the operations for the methods described herein may be implemented using software instructions stored on a computer usable storage medium for execution by a computer. As an example, an embodiment of a computer program product includes a computer usable storage medium to store a computer readable program.

The computer-usable or computer-readable storage medium can be an electronic, magnetic, optical, electromagnetic, infrared, or semiconductor system (or apparatus or device). Examples of non-transitory computer-usable and computer-readable storage media include a semiconductor or solid-state memory, magnetic tape, a removable computer diskette, a random-access memory (RAM), a read-only memory (ROM), a rigid magnetic disk, and an optical disk. Current examples of optical disks include a compact disk with read only memory (CD-ROM), a compact disk with read/write (CD-R/W), and a digital video disk (DVD).

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A method comprising:

obtaining an outline definition of an outline;

using the outline definition to determine a plurality of exterior points of an exterior path;

determining a plurality of interior points of an interior path that is inside the exterior path; and using the exterior path and the interior path to produce sewing data that includes an edge stitch pattern definition for an edge stitch pattern that includes a plurality of edge stitches that are arranged as a plurality of stitch bundles, wherein the stitch bundles are fan shaped and extend from the exterior path to the interior path, the exterior points and the interior points indicate a plurality of needle penetrations for sewing the edge stitch pattern, the sewing data is configured for use by an embroidery machine to sew the edge stitch pattern and thereby produce simulated overlock stitching.

2. The method of claim 1, wherein:

the stitch bundles include a first one of the stitch bundles, a second one of the stitch bundles, and a third one of the stitch bundles;

the second one of the stitch bundles is sewn after the first one of the stitch bundles is sewn;

the third one of the stitch bundles is sewn after the second one of the stitch bundles is sewn;

the edge stitch pattern definition specifies a plurality of running stitches;

the second one of the stitch bundles includes an extended point;

the third one of the stitch bundles includes a second extended point;

one of the running stitches extends from the extended point to the second extended point; and the one of the running stitches is sewn after the first one of the stitch bundles is sewn and before the third one of the stitch bundles is sewn.

3. The method of claim 2, wherein:

the edge stitch pattern definition specifies a plurality of middle run stitches between the running stitches and the exterior path;

the middle run stitches are parallel to the running stitches and the exterior path; and one of the middle run stitches is sewn before the third one of the stitch bundles is sewn and after the first one of the stitch bundles is sewn.

4. The method of claim 1, further including storing the sewing data on a non-transitory storage medium.

5. The method of claim 1, further including producing the simulated overlock stitching by sewing the edge stitch pattern.

6. The method of claim 1, further including:

obtaining a plurality of sewing parameters, wherein the sewing parameters include an edge stitch width, and the edge stitch width is used to determine an offset between the exterior path and the interior path.

7. The method of claim 1, further including:
calculating a plurality of edge angles at a plurality of the interior points;
using the edge angles to determine that one of the interior points is a divergence point;
using the divergence point to identify a one of the exterior points that is a segment endpoint;
identifying a first end segment and a second end segment that overlap at the segment endpoint;
producing a plurality of lapped corner stitch definitions for a plurality of lapped corner stitches; and
including the lapped corner stitch definitions in the edge stitch pattern definition,
wherein sewing the lapped corner stitches produces a lapped corner where the first end segment and the second end segment overlap.

8. The method of claim 7, wherein:
an overlapping corner stitch is a one of the lapped corner stitches of the first end segment that is inside the second end segment; and
the edge stitch pattern definition is adjusted to exclude a plurality of overlapping corner stitches from the edge stitch pattern.

9. The method of claim 7, further including:
comparing the edge angles to a threshold edge angle,
wherein
the one of the interior points is the divergence point because a one of the edge angles at the one of the interior points is less than the threshold edge angle
is the one of the exterior points is the segment endpoint because a one of the edge angles at the one of the exterior points is less than the threshold edge angle.

10. The method of claim 1, further including:
calculating a plurality of edge angles at a plurality of the exterior points;
using the edge angles to determine that one of the interior points is a segment endpoint;
identifying a first end segment and a second end segment that overlap at the segment endpoint;
producing a plurality of lapped corner stitch definitions for a plurality of lapped corner stitches; and
including the lapped corner stitch definitions in the edge stitch pattern definition,
wherein sewing the lapped corner stitches produces a lapped corner where the first end segment and the second end segment overlap.

11. The method of claim 1, further including:
producing a plurality of cover stitch definitions for a plurality of cover stitches that have a plurality of outside edge stitch points spaced at an initial spacing value along the exterior path, that have a plurality of inside edge stitch points along the interior path, and that overlay an edge area that is between the outside edge and the interior path;
grouping the cover stitch definitions into a plurality of stitch bundle definitions for the stitch bundles;
increasing an intra-bundle spacing of the outside edge stitch points to a final spacing value; and
decreasing the intra-bundle spacing of the inside edge stitch points.

12. The method of claim 11, wherein
the stitch bundle definitions include a plurality extended stitch definitions for a plurality of extended stitches, wherein
the extended stitches extend from the exterior path to a plurality of extended points, and
the extended stitches extend past the interior path.

13. The method of claim 12, wherein none of the stitch bundle definitions include more than one of the extended stitch definitions.

14. The method of claim 13, further including:
calculating a plurality of edge angles at a plurality of the outside edge stitch points;
using the edge angles to determine that one of the outside edge stitch points is a segment endpoint;
identifying a first end segment and a second end segment that overlap at the segment endpoint;
producing a plurality of lapped corner stitch definitions for a plurality of lapped corner stitches; and
including the lapped corner stitch definitions in the edge stitch pattern definition,
wherein sewing the lapped corner stitches produces a lapped corner where the first end segment and the second end segment overlap.

15. A non-transitory computer readable medium storing computer readable instructions, that when executed on one or more processors implements a method comprising:
obtaining an outline definition of an outline;
using the outline definition to determine a plurality of exterior points of an exterior path;
determining a plurality of interior points of an interior path that is inside the exterior path; and
using the exterior path and the interior path to produce sewing data that includes an edge stitch pattern definition for an edge stitch pattern that includes a plurality of edge stitches that are arranged as a plurality of stitch bundles,
wherein
the stitch bundles are fan shaped and extend from the exterior path to the interior path,
the exterior points and the interior points indicate a plurality of needle penetrations for sewing the edge stitch pattern,
the sewing data is configured for use by an embroidery machine to sew the edge stitch pattern and thereby produce simulated overlock stitching.

16. The non-transitory computer readable medium storing the computer readable instructions that when executed on the one or more processors implements the method of claim 15, wherein:
the stitch bundles include a first one of the stitch bundles, a second one of the stitch bundles, and a third one of the stitch bundles;
the second one of the stitch bundles is sewn after the first one of the stitch bundles is sewn;
the third one of the stitch bundles is sewn after the second one of the stitch bundles is sewn;
the edge stitch pattern definition specifies a plurality of running stitches;
the second one of the stitch bundles includes an extended point;
the third one of the stitch bundles includes a second extended point;
one of the running stitches extends from the extended point to the second extended point; and
the one of the running stitches is sewn after the first one of the stitch bundles is sewn and before the third one of the stitch bundles is sewn.

17. The non-transitory computer readable medium storing the computer readable instructions that when executed on the one or more processors implements the method of claim 16, wherein:

the edge stitch pattern definition specifies a plurality of middle run stitches between the running stitches and the exterior path;

the middle run stitches are parallel to the running stitches and the exterior path; and one of the middle run stitches is sewn before the third one of the stitch bundles is sewn and after the first one of the stitch bundles is sewn.

18. A system comprising:

an exterior path definition means for defining an exterior path;

an interior path definition means for defining an interior path that is inside the exterior path;

an edge stitch definition means for defining an edge stitch pattern that includes a plurality of edge stitches that are arranged as a plurality of stitch bundles; and a sewing data means that includes the edge stitch definition means, wherein the exterior path definition means and the interior path definition means are used to produce the edge stitch definition means, the stitch bundles are fan shaped and extend from the exterior path to the interior path, the sewing data means is configured for use by a sewing means to sew the edge stitch pattern and thereby produce simulated overlock stitching.

19. The system of claim 18, further including:

a means for identifying a first end segment and a second end segment; and a means for defining a plurality of lapped corner stitches that are included in the edge stitch pattern, wherein sewing the lapped corner stitches produces a lapped corner where the first end segment and the second end segment overlap.

20. The system of claim 18, wherein:

the sewing data means includes a running stitch definition means for defining a plurality of running stitches;

the sewing data means includes a middle run stitch definition means for defining a plurality of middle run stitches; and sewing the simulated overlock stitching produces the running stitches and the middle run stitches.

* * * * *